US007437111B2

(12) United States Patent
Yamada et al.

(10) Patent No.: US 7,437,111 B2
(45) Date of Patent: Oct. 14, 2008

(54) FIXING DEVICE, AND IMAGE FORMING APPARATUS USING THE FIXING DEVICE

(75) Inventors: Hiroshi Yamada, Numazu (JP); Fumihiro Sasaki, Fuji (JP); Shigeru Emoto, Numazu (JP); Jun Okamoto, Nerima-ku (JP); Shinji Ohtani, Sunto-gun (JP); Hiroto Higuchi, Numazu (JP); Naohito Shimota, Numazu (JP); Shinichiro Yagi, Numazu (JP); Junichi Awamura, Numazu (JP); Tomomi Suzuki, Numazu (JP); Masami Tomita, Numazu (JP); Toshiki Nanya, Mishima (JP); Yoshiki Yamaguchi, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 11/058,278

(22) Filed: Feb. 16, 2005

(65) Prior Publication Data

US 2005/0180786 A1 Aug. 18, 2005

(30) Foreign Application Priority Data

Feb. 16, 2004 (JP) ..... 2004-039107
Jul. 27, 2004 (JP) ..... 2004-218496
Jul. 30, 2004 (JP) ..... 2004-222780

(51) Int. Cl.
*G03G 15/20* (2006.01)

(52) U.S. Cl. ..... 399/327

(58) Field of Classification Search ..... 399/327, 399/355, 92

See application file for complete search history.

(56) References Cited

U.S. PATENT DOCUMENTS 4,231,653 A * 11/1980 Nagahara et al. ..... 399/325
4,579,802 A * 4/1986 Kishi et al. ..... 439/99
4,607,947 A 8/1986 Ensing et al.
5,500,318 A 3/1996 Tanikawa et al.
6,516,165 B2 * 2/2003 Makihira et al. ..... 399/69

(Continued)

FOREIGN PATENT DOCUMENTS

CN 1203384 12/1998

(Continued)

OTHER PUBLICATIONS

Patent Abstracts of Japan, JP 59-101685, Jun. 12, 1984 (reference previously filed in Japanese language on Sep. 26, 2005).

(Continued)

*Primary Examiner*—David M Gray
*Assistant Examiner*—Joseph S. Wong
(74) *Attorney, Agent, or Firm*—Oblon, Spivak, McClelland, Maier & Neustadt, P.C.

(57) ABSTRACT

An image forming apparatus including an image bearing member; a charger; a light irradiator; a developing device; a transfer device; an imagebearingmember's cleaner; and a fixing device, wherein the fixing device includes a fixing member configured to fix a toner image upon application of heat and pressure thereto; a pressing member configured to press the recording material toward the fixing member; and a cleaning member configured to clean a surface of the fixing member and/or the pressing member, wherein the cleaning member has an outermost layer including a reactive material which increases viscoelasticity of a binder resin of the toner by reacting with the binder resin.

35 Claims, 8 Drawing Sheets

U.S. PATENT DOCUMENTS

| | | | | |
|---|---|---|---|---|
| 2003/0016973 | A1* | 1/2003 | Macht et al. | 399/327 |
| 2003/0027074 | A1 | 2/2003 | Emoto et al. | |
| 2004/0228648 | A1* | 11/2004 | Yanagida et al. | 399/100 |
| 2005/0008388 | A1* | 1/2005 | Karasawa | 399/92 |
| 2005/0019069 | A1* | 1/2005 | Katayanagi et al. | 399/327 |
| 2005/0025520 | A1* | 2/2005 | Murakami et al. | 399/111 |
| 2005/0180786 | A1 | 8/2005 | Yamada et al. | |

FOREIGN PATENT DOCUMENTS

| | | | |
|---|---|---|---|
| CN | 1416025 | | 5/2003 |
| EP | 1 293 839 | A2 | 3/2003 |
| EP | 1 308 791 | | 5/2003 |
| EP | 1 308 791 | A1 | 5/2003 |
| JP | 59-101685 | | 6/1984 |
| JP | 2-52382 | | 2/1990 |
| JP | 05-006030 | | 1/1993 |
| JP | 5-53372 | | 3/1993 |
| JP | 5-107803 | | 4/1993 |
| JP | 5-289399 | | 11/1993 |
| JP | 5-297630 | | 11/1993 |
| JP | 5-313413 | | 11/1993 |
| JP | 6-27733 | | 2/1994 |
| JP | 6-118702 | | 4/1994 |
| JP | 9-325550 | | 12/1997 |
| JP | 11-149180 | | 6/1999 |
| JP | 2000-292981 | | 10/2000 |
| JP | 2002-123119 | | 4/2002 |

OTHER PUBLICATIONS

Patent Abstracts of Japan, JP 02-052382, Feb. 21, 1990 (reference previously filed in Japanese language on Sep. 26, 2005).
U.S. Appl. No. 11/194,589, filed Aug. 2, 2005, Yamada, et al.
U.S. Appl. No. 11/608,521, filed Dec. 8, 2006, Satoru, et al.
U.S. Appl. No. 11/519,893, filed Sep. 13, 2006, Inoue, et al.
U.S. Appl. No. 11/512,385, filed Aug. 30, 2006, Tomita.
U.S. Appl. No. 11/513,175, filed Aug. 31, 2006, Ohki, et al.
U.S. Appl. No. 11/685,872, filed Mar. 14, 2007, Uchinokura, et al.
U.S. Appl. No. 11/687,372, filed Mar. 16, 2007, Yamada, et al.
U.S. Appl. No. 11/687,875, filed Mar. 19, 2007, Kojima, et al.
U.S. Appl. No. 11/685,969, filed Mar. 14, 2007, Uchinokura, et al.
U.S. Appl. No. 11/851,475, filed Sep. 7, 2007, Watanabe, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 12/013,108, filed Jan. 11, 2008, Yagi, et al.
U.S. Appl. No. 12/040,451, filed Feb. 29, 2008, Saitoh, et al.
U.S. Appl. No. 12/047,437, filed Mar. 13, 2008, Kuramoto, et al.
U.S. Appl. No. 12/050,502, filed Mar. 18, 2008, Yamada, et al.

* cited by examiner

FIXING DEVICE, AND IMAGE FORMING APPARATUS USING THE FIXING DEVICE

BACKGROUND OF THE INVENTION

1. Field of the Invention

The present invention relates to a fixing device for fixing a toner image. More particularly, the present invention relates to a fixing device for use in electrophotographic image forming apparatus, such as copiers, facsimile machines and laser printers, which fixes toner images formed by a direct or indirect monochrome electrophotographic developing method or a direct or indirect full color electrophotographic developing method. In addition, the present invention also relates to an image forming apparatus using the fixing device.

2. Discussion of the Background

When a toner image formed by an electrophotographic image forming method is fixed, heat fixing methods using a heat roller are typically used. In heat roller fixing methods, a toner image formed on a recording material is contacted and heated with a heat roller, which has a good releasability from the toner, upon application of pressure to the toner image, resulting in fixation of the toner image on the recording material. The heat roller fixing methods have an advantage of having excellent heat efficiency in fusing a toner image because the toner image to be fixed contacts the surface of a heating roller (i.e., a fixing roller) while being pressed by a pressing roller. Therefore, toner images can be rapidly fixed on recording materials.

However, the heat roller fixing methods tends to cause an offset problem in that part of a fused toner image, which contacts the surface of a heating roller under pressure, is adhered and transferred to the surface of the heating roller, and then the part of the toner image is re-transferred to an undesired portion of the sheet itself or the following sheet of the recording material. Whether or not the offset problem occurs largely depends on the fixing speed and the fixing temperature of the fixing device used.

In general, when the fixing speed is high, the temperature of the surface of the heating roller is set to be relatively high, to apply substantially a constant amount of heat to the toner image to be heated independently of the fixing speed.

When a full color image is formed, a plurality of color toner layers are overlaid on a recording material. If such a full color toner image is fixed with a heating roller at a high speed, the difference in temperature of the uppermost toner layer and the lowermost toner layer is large. In this case, the heating roller tends to be heated to a high temperature to fully fix the lowermost toner layer. Therefore, the uppermost toner layer is heated to a high temperature, and thereby a hot offset problem tends to be caused. If the temperature of the heating roller is decreased to avoid the hot offset problem, another problem in that the lowermost toner layer is not fully fixed, resulting in occurrence of a cold offset phenomenon in that the unfixed toner layer adheres to the heating roller.

In attempting to solve the problems, a method in which when the fixing speed is high, the fixing pressure is increased so that the toner image to be fixed is anchored to a recording material is used. In this case, the temperature of the heat roller can be decreased to some extent, and thereby the hot offset problem of the uppermost toner layer can be avoided. However, the shearing force applied to the toner image to be fixed is increased, and thereby another problem arises in that the recording sheet is wound around the heating roller, resulting in jamming of the recording sheet. Alternatively, even when such a jamming problem does not occur, a problem in that the resultant image has a white scratch image because the toner image is scratched with a separation pick which is configured to separate the recording material from the heating roller tends to occur. In addition, when the fixing pressure is high, problems in that fine line images are widened, and/or toner particles in the toner image are scattered tend to occur, resulting in deterioration of image qualities.

With respect to toner, a toner having a relatively low melt viscosity at the fixing temperature is typically used when the fixing speed is relatively high. In this case, the temperature and pressure of the heating roller are decreased to avoid the hot offset problem and the jamming problem (i.e., the recording paper winding problem). On the other hand, recently a need exists for a toner which can be used in a wide fixing speed range without causing the offset problems and the jamming problem. When such a toner is use data low fixing speed, the hot offset problem tends to occur. Namely, there is no toner which can be used in a wide fixing speed range.

On the other hand, recently a need exists for high quality images having good fine line reproducibility. In attempting to fulfill this need, the particle diameter of toner is decreased more and more. When such a toner having a small particle diameter is used, the fixing properties of half tone images deteriorate particularly when the fixing speed is relatively high. This is because the amount of toner particles in a half tone image is relatively small and the amounts of heat and pressure applied to the half tone image are small particularly when the half tone image is formed on a recessed portion of a recording material. In addition, the shearing force applied to one toner particle in a half tone image formed on a projected portion of a recording material is relatively high compared to that applied to a toner particle in a solid image, because the toner layer in the half tone image is thin. Therefore, the offset problem easily occurs at the projected portion. Thus, the resultant half tone image tends to have poor image qualities.

In attempting to impart a good combination of fixability and offset resistance to toner, the binder resins therefor have been actively investigated. For example, published unexamined Japanese Patent Application No. 05-107803 (hereinafter referred to as JP-A) discloses a technique in that a resin having a molecular weight distribution such that at least one peak is present in each of the ranges of from $10^3$ to $7\times10^4$ and from $10^5$ to $2\times10^6$ is used as a binder resin.

JP-As 05-289399 and 05-313413 have disclosed a technique in that a vinyl copolymer having a specific molecular weight is used as a binder resin, and a release agent such as polyethylene is used in combination therewith, to impart a good combination of fixing property and offset resistance to the resultant toner.

JP-A 05-297630 discloses a technique in that a combination of a resin having a low melt viscosity and a resin having a high melt viscosity is used as a binder resin to improve the low temperature fixability and hot offset resistance of the toner.

In addition, JP-As 05-053372 and 06-118702 have disclosed a technique in that a resin having a relatively wide molecular weight distribution is used as a binder resin to impart a well-balanced combination of preservability, fixability and hot offset resistance to the resultant toner.

Conventional electrophotographic image forming apparatus typically includes a fixing device in which a recording material bearing a toner image thereon is fed through a nip between a heating roller having a heat source therein and a pressing roller which presses the recording material toward the heating roller while feeding the recording material, to fix the toner image on the recording material.

As mentioned above, such a fixing device tends to cause the offset problem in that the toner image on the recording material is adhered to the heating roller, and the toner image is re-transferred to an undesired portion of the sheet or the following sheet of the recording material. When such offset phenomenon is caused, the toner image adhered to the heating roller is also transferred to the pressing roller contacting the heating roller, and thereby a problem in that a toner image is re-transferred to the backside of the recording sheet or the following recording sheet is also caused. In attempting to avoid such an offset problem, a technique in that the surface of the heating roller is coated with a fluorine-containing compound is proposed. However, even though such a heating roller is used, it is impossible to perfectly prevent occurrence of the offset problem when the environmental conditions and the recording materials are changed.

In order to prevent heating rollers and pressing rollers from being contaminated with transferred toner particles, a technique in that a cleaning device is provided so as to contact the heating rollers and the pressing rollers is proposed. For example, a cleaning device having a metal roller is used. The metal roller is contacted with the heating rollers and pressing rollers to catch the toner particles thereon utilizing difference in toner releasability between the metal roller and the heating rollers and pressing rollers, which are treated to a toner releasing treatment.

Recent image forming apparatus typically adopt a fixing method in which a power is not applied to a heat source of the fixing device thereof in a waiting time to eliminate waste electric consumption, and a power is timely applied thereto when an image forming operation is ordered. Therefore, it is necessary to rapidly increase the temperature of the heating roller of the fixing device to the fixing temperature, i.e., it is necessary to improve the heat response of the heating roller. Therefore, a roller having a thickness not greater than 1 mm, which can be heated to the fixing temperature within a time of about 10 seconds, is typically used as the heating roller.

In such image forming apparatus using a heating roller with a small heat capacity, the temperature of the heating roller tends to be influenced by heat transfer from the heating roller to recording sheets and the members contacting the heating roller and other factors such as direction of flow of air surrounding the heating roller. Therefore, the image forming apparatus has a problem in that the temperature of the heating roller varies in the width direction thereof. However, this problem is not yet solved, namely it is difficult to uniformly heat the entire of such a heating roller to a predetermined fixing temperature because of the structural limitation and cost limitation.

When the temperature of a heating roller becomes uneven in the width direction thereof, good fixing properties cannot be stably obtained and the offset problem tends to be caused. In addition, the life of the heating roller is shortened due to heat deterioration of the heating roller. In particular, when the polymerized toner disclosed in, for example, JP-A 2000-292981 is used, a problem in that toner blocks adhered to and accumulated on a cleaning member are re-melted and transferred to a recording sheet occurs. When a toner prepared by a pulverization method is used, such a problem hardly occurs. This is because toner particles having a high storage modulus are typically adhered to such a cleaning member whereas toner particles with a low storage modulus are adhered to the cleaning member in the case of polymerization toners.

This problem is typically caused when recording sheets with a narrow width are used. The reason therefore is considered as follows. The temperature of only the central portion of the heating roller contacting the narrow recording sheets is decreased, and the heat source for the heating roller heats the entire heating roller because the temperature fall of the central portion of the heating roller is detected by a temperature sensor provided on the central portion of the heating roller. Therefore, the temperature of both the end portions of the heating rollers is excessively increased, and thereby the toner blocks present on both end portions of the cleaning member are fused and re-transferred to the pressing roller and heating roller.

In attempting to solve this problem, JP-A 09-325550 discloses a technique in that air blows both end portions of a heating roller to prevent the temperature of the end portions from being excessively raised. In addition, JP-A 2002-123119 discloses a technique in that air holes are provided along the cleaning roller so that air in the fixing device is circulated with rotation of the cleaning roller, thereby preventing the temperature of the cleaning roller from being excessively raised.

Because of these reasons, a need exists for a fixing device which includes a cleaning device and which does not cause the toner re-transferring problem in that toner particles adhered to the cleaning member is not re-transferred to the. fixing member.

STORY OF THE INVENTION

Accordingly, an object of the present invention is to provide a fixing device which includes a cleaning member and which can produce high quality toner images without causing the toner re-transferring problem in that toner particles adhered to the cleaning device is re-transferred to the fixing member and pressing member.

Another object of the present invention is to provide an image forming apparatus which can produce high quality toner images without causing undesired images such as offset images.

Briefly these objects and other objects of the present invention as hereinafter will become more readily apparent can be attained by a fixing device for fixing a toner image, which includes:

- a fixing member configured to fix the toner image upon application of heat and pressure thereto;
- a pressing member configured to press the recording material toward the fixing member; and
- a cleaning member configured to clean a surface of at least one of the fixing member and the pressing member while contacting the at least one of the fixing member and the pressing member, wherein the cleaning member has an outermost layer contacting the at least one of the fixing member and the pressing member, and wherein the outermost layer includes a reactive material (hereinafter sometimes referred to as a viscoelasticity increasing material) which increases the viscoelasticity of a binder resin included in the toner by reacting the binder resin.

The fixing member is preferably either a fixing roller or a fixing belt supported by a plurality of rollers.

The viscoelasticity increasing material is preferably a metal compound.

It is preferable that the outermost layer of the cleaning member further includes a binder resin. The binder resin is preferably included in the outermost layer in an amount of from 5 to 80% by weight based on total weight of the outermost layer.

It is preferable that the fixing device further includes a supply member configured to supply the viscoelasticity increasing material to the cleaning member and/or an air blower configured to blow air on the cleaning member to cool the cleaning member.

The surface of the cleaning member preferably has a ten point mean roughness Rz of from 3 to 50 μm.

As another aspect of the present invention, an image forming apparatus is provided which includes:

an image bearing member configured to bear an electrostatic latent image on a surface thereof;

a charger configured to charge the image bearing member;

a light irradiator configured to irradiate the charge image bearing member with imagewise light to prepare the electrostatic latent image;

a developing device configured to develop the latent image with a developer including a toner including a first binder resin and a colorant to form a toner image on the surface of the image bearing member;

a transfer device configured to transfer the toner image on a recording material;

an image bearing member's cleaner configured to clean the surface of the image bearing member; and the fixing device configured fix the toner image on the recording material, wherein the fixing device includes:

a fixing member configured to fix the toner image upon application of heat and pressure thereto;

a pressing member configured to press the recording material toward the fixing member; and a cleaning member configured to clean a surface of at least one of the fixing member and the pressing member while contacting the surface of the at least one of the fixing member and the pressing member, wherein the cleaning member has an outermost layer contacting the surface of the at least one of the fixing member and the pressing member, and wherein the outermost layer includes a viscoelasiticity increasing material.

The fixing member is preferably either a fixing roller or a fixing belt supported by a plurality of rollers.

The viscoelasiticity increasing material preferably includes a metal compound selected from the group consisting of metal salts of naphthenic acids and fatty acids, metal complexes of azo compounds, metal salts of salicylic acid, metal complexes of salicylic acid, chelate compounds including Si, Zr and Al, metal alkoholates including Si, Zr and Al.

It is preferable that the outermost layer further includes a binder resin, which preferably has a unit which is the same as a unit included in the first binder resin. The second binder resin is preferably included in the outermost layer in an amount of from 5 to 80% by weight based on total weight of the outermost layer.

It is preferable that the fixing device further includes a supplying member configured to supply the viscoelasticity increasing material to the cleaning member and/or an air blower configured to blow air on the cleaning member to cool the cleaning member.

The surface of the cleaning roller preferably has a ten point mean roughness Rz of from 3 to 50 μm.

It is preferable that the toner further includes a release agent and/or a charge controlling agent.

The toner preferably has an average circularity not less than 0.94. In addition, the toner preferably has a volume average particle diameter of from 3.0 to 8.0 μm, and a ratio (Dv/Dn) of the volume average particle diameter (Dv) to a number average particle diameter (Dn) of from 1.00 to 1.40. Further, the toner preferably has a first shape factor SF-1 of from 100 to 180 and a second shape factor SF-2 of from 100 to 180. Furthermore, the toner preferably has substantially a spherical form satisfying the following relationships:

$$0.5 \leqq r2/r1 \leqq 1.0, \text{ and } 0.7 \leqq r3/r2 \leqq 1.0,$$

wherein r1, r2 and r3 represent an average major axis particle diameter, an average minor axis particle diameter and an average thickness of the toner, wherein $r3 \leqq r2 \leqq r1$.

The toner is preferably prepared by a method including:

dissolving or dispersing, a toner constituent mixture including a polymer capable of reacting with an active hydrogen atom, a polyester resin, and the colorant in an organic solvent to prepare a toner constituent mixture liquid; and dispersing the toner constituent mixture liquid in an aqueous medium while subjecting the polymer to at least one of an extension reaction and a crosslinking reaction using a compound having an active hydrogen atom to prepare a dispersion including toner particles including the first binder resin.

In addition, it is preferable that the tetrahydrofuran-soluble components included in the toner have an acid value parameter of from $0.3\times10^{-3}$ to $5.0\times10^{-3}$ mgKOH/Mw; a weight average molecular weight of from 5,000 to 30,000; and/or an acid value of from 2.0 to 50.0 mgKOH/g.

It is preferable that the image forming apparatus further includes a process cartridge which can be detachably set in the image forming apparatus, wherein the process cartridge includes the image bearing member and at least one of the charger, developing device and the image bearing member's cleaner.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, the fixing device of the present invention will be explained referring to drawings.

Figure 1:
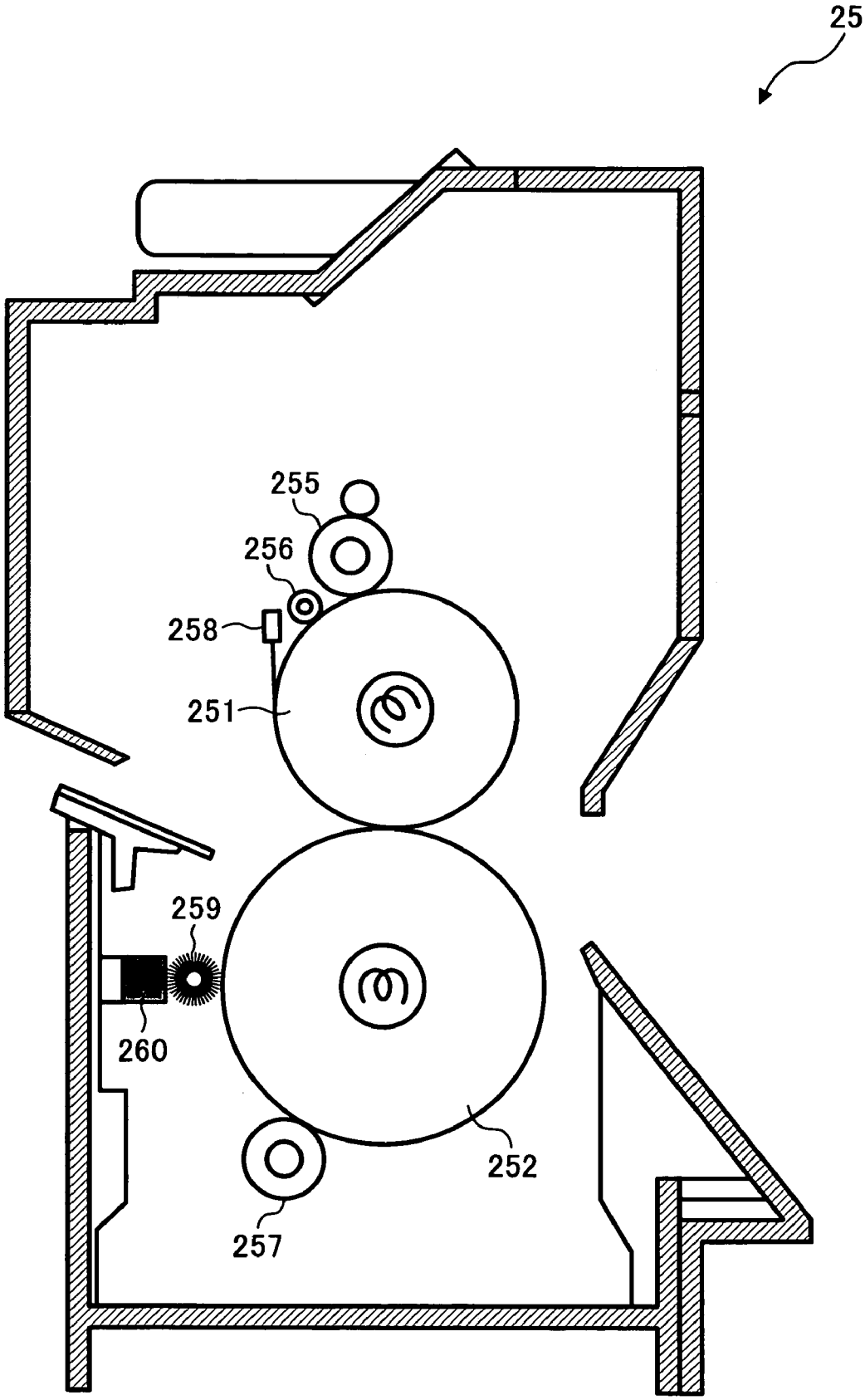
FIG. 1 is a schematic view illustrating an embodiment of the fixing device of the present invention, which includes a heating roller and a pressing roller.

FIG. 1 is a schematic view illustrating an embodiment of the fixing device of the present invention, which includes a heating roller and a pressing roller.

A fixing device 25 includes a fixing roller 251 (i.e., a heating roller) serving as a fixing member, and a pressing roller 252 serving as a pressing member. The fixing roller 251 includes a metal cylinder made of ametal such as stainless steel and aluminum, an elastic layer which is formed overlying the metal cylinder and which is made of a heat resistant elastic material such as silicone rubbers and foamed silicone rubbers, and a release layer which is formed overlying the elastic layer which has good releasability from recording materials and toners. The elastic layer is provided such that the fixing roller 251 and the pressing roller 252 can forma nip. Materials having good heat resistance and low surface energy are preferably used for the release layer. Specific examples of such materials include silicone resins, fluorine-containing resins (e.g., tetrafluoroethylene (PTFE), tetrafluoroethylene-perfluoroalkyl vinyl ether copolymers (PFA) and tetrafluoroethylene-hexafluoropropylene copolymers (FEP)) The release layer is prepared by, for example, covering the cylinder having the elastic layer with a tube made of such heat resistant materials as mentioned above. In addition, a heat source such as halogen heaters is arranged in the metal cylinder of the fixing roller 251.

The pressing roller 252 includes a metal cylinder, an elastic layer which is made of a heat resistant elastic material such as fluorine-containing resins and silicone rubbers, and a release layer which is made of a release material such as fluorine-containing resins.

The pressing roller 252 is pressed toward the fixing roller 251 by a pressing member such as springs (not shown). In this case, the elastic layers of the fixing roller 251 and the pressing roller 252 are elastically deformed, resulting in formation of a nip between the rollers. A toner image to be fixed is pressed and heated at the nip for a certain time.

The fixing device 25 further includes a coating roller 255 which coats an oil on the fixing roller 251 to impart good toner releasability to the fixing roller, resulting in prevention of occurrence of the offset problem; and a cleaning roller 256 configured to remove residual toner particles and paper dust adhered to the surface of the fixing roller 251. Since paper dust is adhered to the pressing roller 252 and toner particles are also adhered thereto from the fixing roller when a fixing operation is not performed, a cleaning roller 257 is provided on the surface of the pressing roller 252. In addition, a temperature sensor 258 such as thermisters is provided to check the temperature of the fixing roller 251. Such a temperature sensor can be provided on the pressing roller or other members in the fixing device 25 as well as the fixing roller 251. A numeral 259 represents a brush which scrapes an viscoelasticity increasing material 260 while rotating to supply the material 260 to the pressing roller 252.

Figure 2:
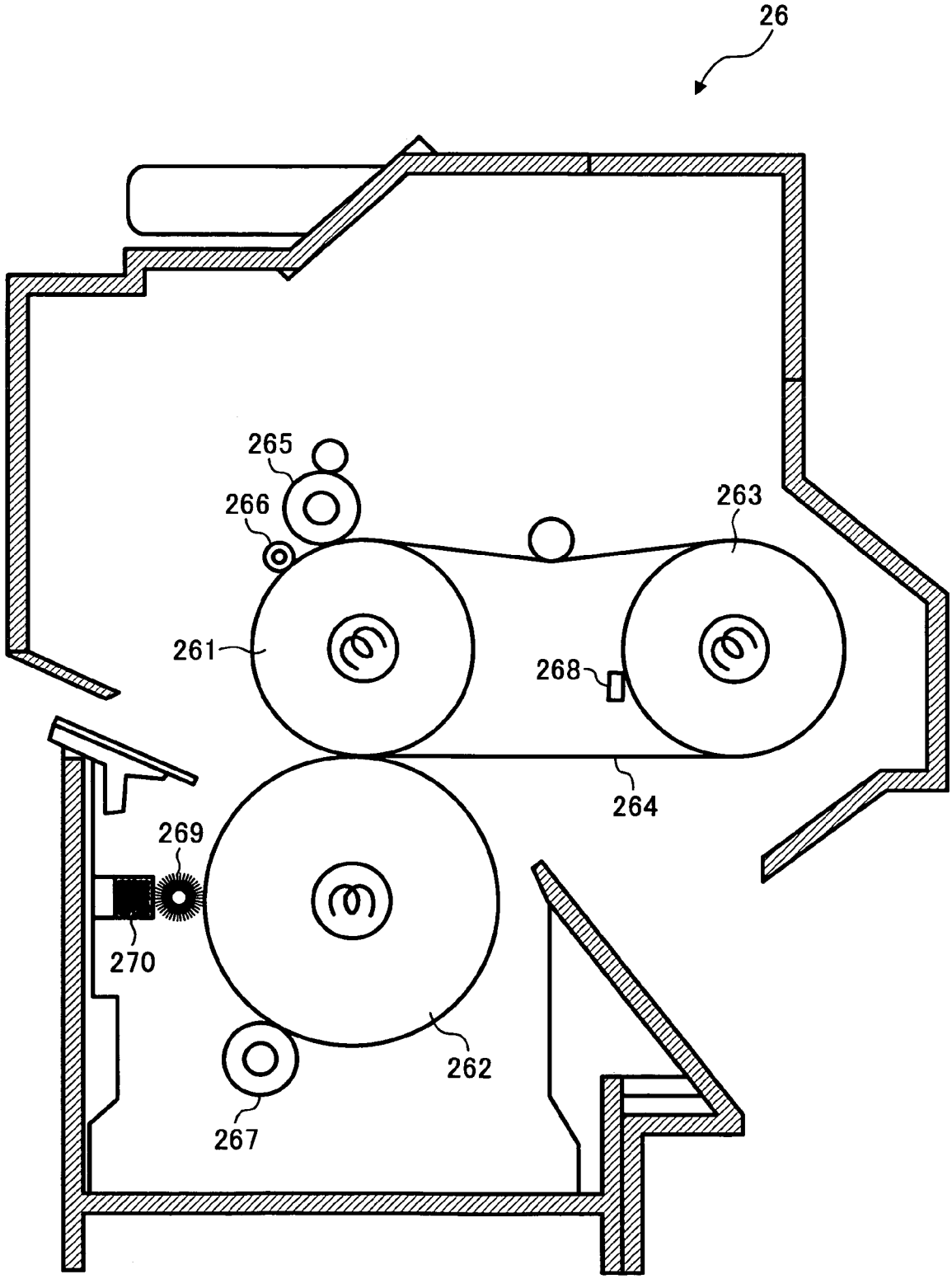
FIG. 2 is a schematic view illustrating another embodiment of the fixing device of the present invention, which includes a fixing belt and a pressing roller.

FIG. 2 is a schematic view illustrating another embodiment of the fixing device of the present invention, which includes a fixing belt as the fixing member.

Referring to FIG. 2, a fixing device 26 includes a heating roller 263, a fixing roller 261, a pressing roller 262, and a fixing belt 264 which is looped around the heating roller 263 and the fixing roller 261 and which is rotated by the rollers.

Each of the fixing roller 261 and the pressing roller 262 has a structure similar to that of the fixing roller 251 and the pressing roller 252. Namely, each roller has a metal cylinder, an elastic layer located overlying the metal cylinder and a release layer located overlying the elastic layer. The thickness of the elastic layer and the release layer is set to a proper thickness, and suitable materials for use in the elastic layer and the release layer include those mentioned above. A heat source such as halogen heaters is provided in each of the fixing roller 261 and the pressing roller 262. The pressing roller 262 is pressed by a pressing member such as springs toward the fixing roller with the fixing belt 264 therebetween. In this case, the elastic layers of the fixing roller 261 and the pressing roller 262 are elastically deformed, resulting in formation of a nip between the fixing belt 264 and the pressing roller 262. A toner image to be fixed is pressed and heated at the nip for a certain time.

The fixing belt 264 includes an endless substrate made of a material such as heat resistant resins, and metals. Specific examples of such heat resistant resins include polyimide resins, polyamideimide resins, polyether ether ketone resins, etc. Specific examples of such metals include nickel, aluminum, stainless steel, etc. Multi-layer belts in which a resin layer and a metal layer are overlaid can be used for the fixing belt 264. In particular, belts in which a nickel layer is formed on a polyimide resin by an electroforming method can be preferably used as the fixing belt 264 because of having good durability. The thickness of the fixing belt 264 is preferably not greater than 100 μm. The fixing belt 264 preferably includes an elastic layer which is formed of a material having good releasability such as silicone rubbers and a release layer which is formed overlying the elastic layer and which is made of a material having low friction coefficient such as fluorine-containing resins.

The heating roller 263 heats the fixing belt 264 while tightly stretching the fixing belt together with the fixing roller 261. A heat source such as halogen lamps and nichrome wires is provided inside the heating roller 263. The heating roller 263 is a thin cylinder made of a metal such as aluminum, carbon steel and stainless steel. The heating roller 263 is preferably made of an aluminum cylinder with a thickness of from 1 to 4 mm to control the temperature in the longitudinal direction of the heating roller 263 so as to be uniform. In this case, the surface of the fixing roller 263 is preferably subjected to a surface treatment to form an alumite film thereon, which prevents abrasion of the heating roller 263 due to friction between the fixing belt 264 and the heating roller 263.

In addition, the fixing device 26 includes a temperature sensor 268, such as thermocouples and thermisters, which is provided to check the temperature of the peripheral surface of the heating roller 263 (i.e., the surface of the fixing belt 264). The operation of the heater in the heating roller 263 is controlled on the basis of the temperature data obtained by the temperature sensor 268. Numerals 265, 266, 267 and 268 denote an oil supplying roller which coats an oil on the surface of the fixing belt 264, a cleaning roller for the fixing belt 264, a cleaning roller for the pressing roller 262, and a temperature sensor, respectively. These rollers and sensor are similar to the rollers 256 and 257 and the sensor 258, respectively. A numeral 269 denotes a brush which scrapes a viscoelasticity increasing material 270 to supply the material to the pressing roller 262.

Then the fixing operation of a toner image will be explained referring to FIG. 1.

A toner image on a recording material receives heat and pressure at the nip formed by the fixing roller 251 and the pressing roller 252. In this case, the toner image is melted and thereby the viscosity and elasticity thereof are decreased. Since the toner image receives a pressure at that time, the toner spreads on the surface of the recording paper and enters into the fibers constituting the recording paper. Then the recording paper is released from the nip of the rollers 251 and 252. Components with a low molecular weight included in the toner easily enter into the fibers because of having low melt viscosity, and tend to adhere to the surface of the fixing roller 251 because of having low elasticity. Components with a high molecular weight included in the toner have large viscosity and large elasticity. When the high molecular weight components are melted and have a large viscosity, the components on the recording paper tend to be transferred to the fixing roller 251 if the adherence of the components to the fixing roller is greater than the elasticity thereof. If the toner transferred to the fixing roller 251 is contacted again with the recording paper sheet or the following recording paper sheet due to the rotation of the fixing roller 251, a problem in that the paper sheet is contaminated with the toner occurs. In order to prevent occurrence of such a problem, the cleaning roller 257 is provided, and a silicone oil is coated on the surface of the fixing roller 251. In addition, a release agent is included in the toner. However, it is hard to perfectly prevent toner particles from remaining on the fixing roller 251.

When toner particles remain on the fixing roller 251, there is a case where the toner particles are transferred to the pressing roller 252 having a relatively low temperature compared to that of the fixing roller 251. When the toner particles are contacted again with a following recording paper sheet, the backside of the recording paper sheet is soiled with the toner particles. In order to prevent occurrence of this problem, the cleaning roller 257 is provided on the pressing roller 252. The toner particles transferred to the pressing roller 252 are collected with the cleaning roller 257. If the toner collected by the cleaning roller 257 is re-fused by the heat of the fixing roller 25, the toner is re-transferred to the pressing roller 252, resulting in occurrence of an offset problem in that the backside of a recording paper sheet is soiled with the toner. In particular, low molecular weight components included in toner tend to change their viscosity and elasticity relatively easily compared to high molecular weight components therein. Namely, the low molecular weight components in the toner tend to cause the offset problem. In addition, such low molecular weight components are easily re-fused and re-transferred to the pressing roller 252.

The toner particles adhered to the pressing roller 252 are collected by the cleaning roller 257 at the nip between the pressing roller 252 and the cleaning roller 257. The toner particles thus collected with the cleaning roller 257 amount to about a few grams after 150,000 toner images are formed and fixed. Conventional toners typically include a binder resin having a glass transition temperature (Tg) of about 60° C. and therefore the fusing problem of the toner on the cleaning roller 257 is hardly caused even when the temperature of the fixing device 25 and the cleaning roller 257 is raised due to continuous image forming operations. However, when a toner which includes a low molecular weight resin so as to be able to be fixed at a low fixing temperature or at a high fixing speed is used, the toner particles collected by the cleaning roller 257 are easily re-fused, and thereby the toner is adhered to the pressing roller 252 and the fixing roller 251. In this case, the front side and backside of the transfer paper sheets are soiled with the fused toner.

In the fixing device 25 of the present invention, the surface of the cleaning roller 257 is coated with a material (hereinafter referred to as a viscosity increasing material) which can increase the viscoelasticity of the binder resin included in the toner used by reacting with the binder resin. Suitable materials for use as the viscoelasticity increasing materials include materials which can increase the molecular weight of the binder resin included in the toner by subjecting the binder resin to a crosslinking reaction. Specifically, materials which can increase the molecular weight (i.e., the viscoelasticity) by being reacted with the polar groups included in the binder resin are preferably used as the viscoelasticity increasing material. However, the materials are different from the materials such as amines and ketones which are used for crosslinking or extending monomers in a solvent.

Specific examples of the viscoelasticity increasing materials include metal compounds such as metal salts of naphthenic acids and fatty acids, metal complexes of azo compounds, metal salts of salicylic acid, metal complexes (such as Zn, Cr, Fe and Zr) of salicylic acid, chelate compounds of Si, Zr and Al, metal alkoholates of Si, Zr and Al, etc.

By coating such a material on the surface of the cleaning roller 257, the binder resin in the toner particles caught by the surface of the cleaning roller is crosslinked, resulting in increase of the viscoelasticity of the toner particles, and thereby re-fusion and re-transfer of the toner particles can be prevented. Thus, the offset problem can be avoided.

As illustrated in FIG. 1, the viscoelasticity increasing material 260 is preferably supplied by the brush (i.e., supplying member) 259 to the pressing roller 252. The toner particles transferred to the pressing roller 252 are coated with the viscoelasticity increasing material 260 and then transferred to the cleaning roller 257. Therefore, the toner collected by the cleaning roller 257 is reacted with the viscoelasticity increasing material 260, resulting in increase of the viscoelasticity of the collected toner. Accordingly, the collected toner strongly adheres to the cleaning roller 257, and thereby the re-fusion and re-transfer of the toner particles can be prevented.

The method for coating the viscoelasticity increasing material on the surface of the cleaning roller is not particularly limited. For example, a coating liquid which is prepared by dissolving a mixture of a viscoelasticity increasing material and a binder resin in an aqueous medium or an organic solvent is coated on the peripheral surface of a roller. Suitable resins for use as the binder resin of the outermost layer of the cleaning roller include polyester resins, styrene-alkyl (meth) acrylate copolymers, styrene-butadiene copolymers, styrene-acrylonitrile copolymers, polyurethane resins, epoxy resins, silicone resins, polyvinyl chloride resins, polyamide resins, phenolic resins, and xylene resins, but are not limited thereto. In particular, resins having a functional group at the end portions thereof which reacts with the reactive material. Specific examples of the functional groups include carboxyl groups, carbonyl groups, urethane groups, urea groups and sulfonic acid groups, which include a hetero atom. Among these groups, carboxyl groups are preferable because of easily having an interaction with the reactive material through a hydrogen bonding. In addition, since the bonding is relatively weak and exchange of functional groups can be freely performed, the reactive material can be diffused relatively easily.

The binder resin to be included in the coating liquid preferably includes a component similar to those of the binder resin included in the toner used, because the solubility of the toner in the covering layer formed on the cleaning roller 257 can be improved, thereby preventing the collected toner from being re-transferred to the pressing roller.

Suitable solvents for use in the coating liquid include aromatic solvents such as toluene and xylene, ketones such as methyl ethyl ketone, and alcohols such as methanol, ethanol, propanol, isopropanol, t-butanol, methoxyethanol, ethoxyethanol, and butoxyethanol, nitrites such as acetonitrile, ethers such as dioxane, etc.

The coating liquid is preferably coated by a coating method such as roller coating methods, blade coating methods, brush coating methods, and spray coating methods.

Since the viscoelasticity increasing material is included in the covering layer formed on the cleaning roller 257, the toner collected by the cleaning roller is reacted with the viscoelasticity increasing material. Therefore, even when the cleaning roller is heated to a high temperature, the collected toner is prevented from fusing and being re-transferred to the pressing roller. In addition, since the binder resin is included in the covering layer, the adhesiveness of the layer to the cleaning roller can be improved, resulting in prevention of peeling of the layer from the cleaning roller.

Figure 3:
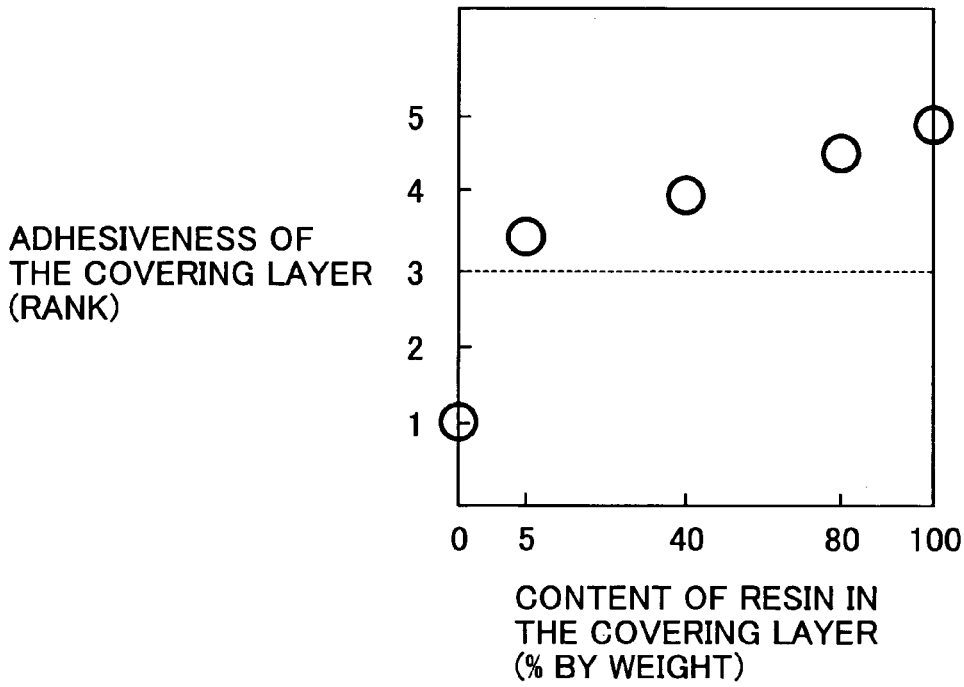
FIG. 3 is a graph illustrating the relationship between the content of resin included in the covering layer and the adhesiveness of the covering layer to the cleaning roller.
Figure 4:
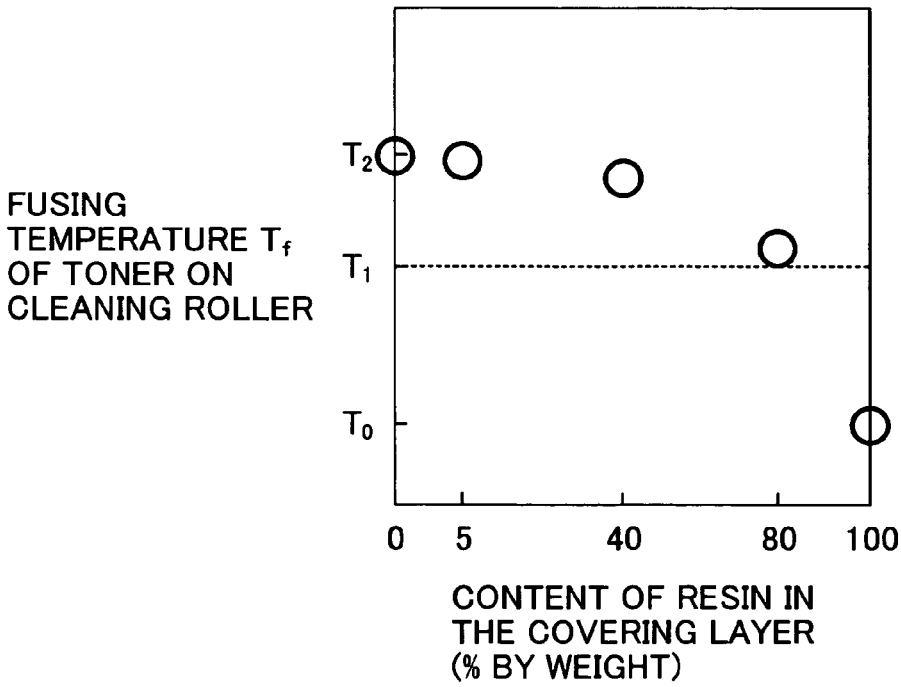
FIG. 4 is a graph illustrating the relationship between the content of resin included in the covering layer and the fusing temperature of toner on the cleaning roller.

FIG. 3 is a graph illustrating the relationship between the content of the binder resin in the covering layer and the adhesiveness of the covering layer of the cleaning roller. FIG. 4 is a graph illustrating the relationship between the content of the binder resin in the covering layer and the fusing temperature at which the collected toner is fused and re-transferred to the pressing roller by releasing from the covering layer.

The adhesiveness of the covering layer is evaluated by the following method:

(1) an adhesive tape is attached to the covering layer;

(2) the adhesive tape is peeled from the covering layer; and (3) the portion of the covering layer from which the adhesive tape is peeled is observed to determine the degree of peeling of the covering layer from the cleaning roller.

The adhesiveness is graded into 5 ranks (rank 5 is the best and rank 1 is the worst). A covering layer having an adhesiveness of rank 3 is acceptable and can be practically used for fixing devices without causing an image quality problem and a peeling problem.

When the adhesiveness of the covering layer is poor, a part of the covering layer is transferred to the pressing roller, resulting in formation of unfixed toner images due to unevenness of the surface of the pressing roller, thereby causing a problem in that background of the resultant toner images is soiled with unfixed toner particles.

When the content of the binder resin in the covering layer is too high (and therefore the content of the viscosity increasing material (i.e., a crosslinking agent) is too low), the collected toner is insufficiently reacted with the viscosity increasing material, resulting in deterioration of the viscoelasticity increasing effect of the covering layer, and thereby the collected toner tends to be re-transferred to the pressing. roller. As can be understood from FIG. 4, the fusing temperature Tf at which the toner collected by the cleaning roller is fused and re-transferred to the pressing roller is not lower than an acceptable temperature T1 if the content of the binder resin in the covering layer is not greater than 80% by weight. Thus, the content of the binder resin in the covering layer is preferably from 5 to 80% by weight based on the total weight of the covering layer. In this regard, the content of 100% means that the viscoelasticity increasing material is not included in the covering layer.

The evaluation method of the fusing temperature Tf is as follows:

(1) a predetermined amount of toner is adhered on the surface of the cleaning roller;

(2) the cleaning roller is set on a pressing roller in a fixing device;

(3) the fixing device is energized (i.e., the fixing roller and the pressing roller are heated) while the rollers are rotated; and (3) the toner on the cleaning roller is observed to determine Whether the toner is re-transferred to the pressing roller (i.e., to determine the fusing temperature Tf of the toner on the cleaning roller).

The cleaning roller 257 of the fixing device 25 includes a roller made of a metal such as SUS, brass, copper and aluminum and having a diameter of from 10 to 30 mm. The surface of the metal roller has a ten point mean roughness Rz of from 3 to 50 μm. In order to impart such a roughness to the metal roller, the metal roller is preferably subjected to a blasting treatment such as shot blasting, sand blasting and liquid horning. Among these blasting methods, sand blasting is preferably used because the treatment can be easily performed. By subjecting the metal roller to the surface treatment, the surface area of the metal roller can be increased, and thereby the adhesiveness of the covering layer to the metal roller can be improved. In this case, the probability of contact of the cleaning roller 257 with the toner particles present on the pressing roller 252 can be increased, resulting in increase of the toner removing efficiency. In addition, the covering layer hardly causes the peeling problem, and can produce good viscoelasticity increasing effect.

Figure 5:
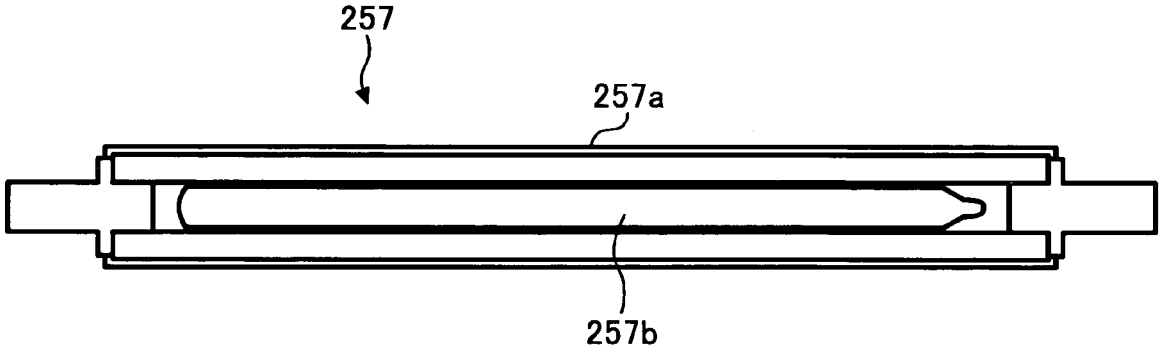
FIG. 5 is a schematic view illustrating a cleaning roller having a heat pipe therein.

FIG. 5 is a schematic view illustrating an embodiment of the cleaning roller 257. As illustrated in FIG. 5, the cleaning roller 257 has a cylinder 257*a* and a heat pipe 257*b* arranged inside the cylinder 257*a*. The toner re-transferring problem is typically caused when the difference in temperature of the paper-contact portions of the pressing roller 252 and the paper-non-contact portions thereof becomes large, and thereby the toner particles present on the portions of the cleaning roller contacting the paper-non-contact portions of the pressing roller are heated to a high temperature. By providing the heat pipe 257*b*, the temperature difference in the longitudinal direction of the cleaning roller can be decreased, resulting in prevention of the toner re-transferring problem.

The cleaning roller 257 has a diameter in a range such that the cleaning roller can be set in the fixing device 25. When the diameter of the cleaning roller is large, the cleaning roller can collect a large amount of toner although the fixing device has a relatively long temperature rising time. In addition, the thickness of the collected toner present on the surface of the cleaning roller per unit weight of the collected toner is small (in other words, the changing rate of the toner layer thickness is small), and the changing rate of the temperature of the cleaning roller is small. Therefore, the fixing device 25 has a good stability.

In contrast, when the diameter of the cleaning roller is small, the thickness of the collected toner present on the surface of the cleaning roller per unit weight of the collected toner is large (in other words, the changing rate of the toner layer thickness is large), and the changing rate of the temperature of the cleaning roller is large, although the fixing device has a short temperature rising time.

Therefore, from this point of view, the diameter of the cleaning roller is preferably from 10 to 30 mm.

A plurality of cleaning rollers can be provided on the pressing roller 252. In addition, one or more cleaning rollers can be provided on the fixing roller 251. In this case, the cleaning roller 257 may not be provided on the pressing roller 252.

Figure 6A:
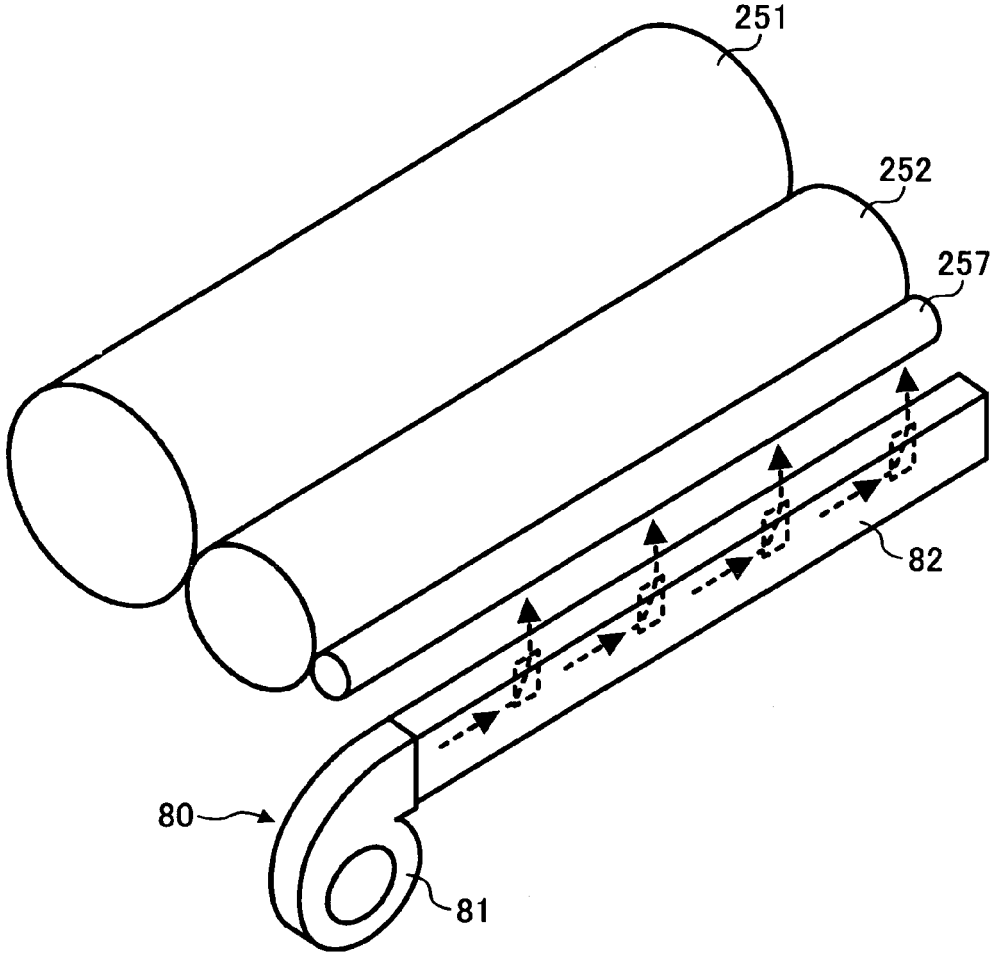
FIGS. 6 are schematic views illustrating an air blower for use in cooling the cleaning roller.
Figure 6B:
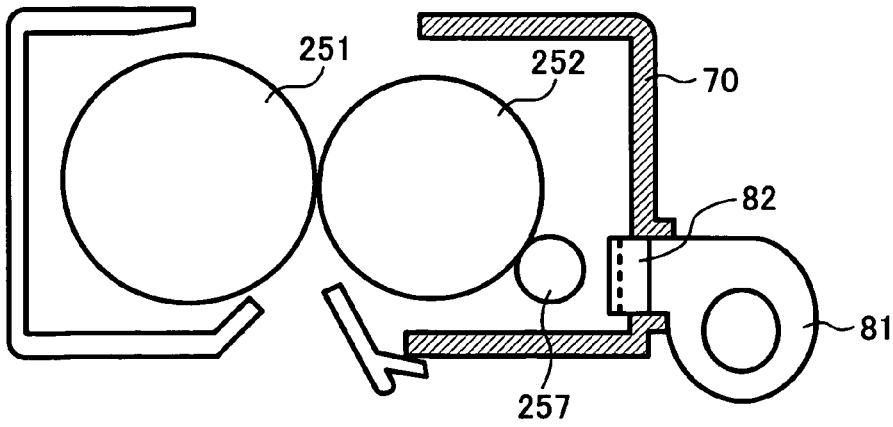

The fixing device of the present invention can include an air blower configured to blow air on the cleaning device to cool the cleaning roller. FIGS. 6A and 6B are schematic views illustrating an embodiment of the air blower for use in the fixing device of the present invention. An air blower 80 include a sirocco fan 81 and a duct 82. The air blower 80 blows air on the cleaning roller 252 to decrease the temperature of the cleaning roller 257, thereby improving the ability of the cleaning roller to prevent occurrence of the toner re-transferring problem. In this case, the air does not directly blow the pressing roller 252 and the fixing roller 251, and thereby the heat efficiency of the fixing device is not deteriorated.

The sirocco fan 81 is provided on an end portion of a case 70 of the fixing device. The sirocco fan takes air in an amount of from 0.1 to 1.0 $m^3$/min, and feeds the air toward the duct 82. The air is discharged from the duct 82 in the direction perpendicular to the paper feeding direction, thereby cooling the cleaning roller 257. Therefore, even when the heat of the fixing roller 251 is transferred to the cleaning roller 257 via the pressing roller 252, occurrence of the toner re-transferring problem can be prevented. When the air flow rate is too low, good cooling effect cannot be produced. In contrast, when the air flow rate is too high, the cleaning roller is excessively cooled, and thereby the pressing roller and the fixing roller tend to be cooled.

In the fixing device 25, the fixing roller 251 is typically heated to a temperature of about 150° C. to fix toner images. In this case, the pressing roller 252 and the cleaning roller 257 are heated to a temperature of about 130° C. and about 120° C., respectively. When the temperature of the cleaning roller is heated to a temperature of about 100° C., the toner re-transferring problem tend to occur. Therefore, it is preferable to cool the cleaning roller to a temperature of about 90° C.

When a toner manufactured by a polymerization method is used, the toner collected and adhered to the cleaning roller has a low storage modulus because the toner constituents are uniformly dispersed in the toner and the particle form of the toner particles is uniform. Therefore, the polymerization toners have relatively low toner fusing temperature compared to toners manufactured by a pulverization method. Even when a toner having a low storage modulus (such as polymerization toners) is used, occurrence of the toner re-transferring problem can be prevented by a combination of the technique in that a viscoelasticity increasing material is included in the covering layer of the cleaning and the technique of using the blower.

Since the blower 80 blows air on only the cleaning roller 257 (i.e., the blower does not directly blow air on the fixing roller 251 and the pressing roller 252), the fixing efficiency of the fixing device is not deteriorated. In particular, the cleaning roller attached to the pressing roller is cooled, and therefore the temperature of the fixing roller is hardly decreased. Accordingly, the fixing efficiency of the fixing device can be maintained.

Then the toner for use in the image forming apparatus of the present invention will be explained.

Any toners such as toners prepared by a pulverization method or a polymerization method can be used as the toner in the present invention. For example, a pulverization toner is typically prepared by the following method:

(1) toner constituents such as a binder resin, a colorant (e.g., pigments and dyes), a charge controlling agent, a release agent and other additives are mixed well using a mixer such as HENSCHEL mixers;
(2) the mixture is kneaded using a kneader such as batch kneaders (e.g., two-roll mills and BUMBURY'S mixers), and continuous kneaders such as double axis kneaders and single axis kneaders;
(3) the kneaded mixture is cooled by rolling;
(4) the cooled mixture is cut, and crushed;
(5) the crushed mixture is pulverized with a pulverizer such as mechanical pulverizers;
(6) the pulverized toner constituent mixture is classified with a classifier, such as classifiers utilizing circulated air and classifiers utilizing the Coanda effect, to prepare a mother toner; and
(7) the mother toner is mixed with an external additive such as inorganic fillers (e.g., silica and titanium oxide) using a mixer, resulting in preparation of a pulverization toner.

A polymerization toner is prepared by, for example, the following method.

(1) toner constituents including a polymer capable of reacting with an active hydrogen atom, a polyester resin, a colorant, a release agent, etc. are dissolved or dispersed in an organic solvent to prepare a toner constituent mixture liquid;
(2) the toner constituent mixture liquid is dispersed in an aqueous medium including a particulate resin to prepare an emulsion; and
(3) the emulsion (i.e., the polymer) is subjected to a crosslinking reaction and/or an extension reaction by reacting the polymer with a compound having an active hydrogen atom, resulting in formation of mother toner particles in the aqueous medium.

As for the binder resin of the toner, known resin for use in toners can be used. Specific examples thereof include polymers and copolymers of monomers such as styrene, p-chlorostyrene, vinyl toluene, vinyl chloride, vinyl acetate, vinylpropionate, methyl (meth)acrylate, ethyl (meth)acrylate, propyl (meth)acrylate, n-butyl (meth)acrylate, iso-butyl (meth)acrylate, dodecyl (meth)acrylate, 2-ethylhexyl (meth) acrylate, lauryl (meth)acrylate, 2-hydroxyethyl (meth)acrylate, hydroxypropyl (meth)acrylate, 2-chloroethyl (meth) acrylate, (meth)acrylonitrile, (meth)acrylamide, (meth) acrylic acid, vinyl methyl ether, vinyl ethyl ether, vinyl isobutyl ether, vinyl methyl ketone, N-vinyl pyrrolidone, N-vinyl pyridine, and butadiene; other resins such as polyester resins, polyol resins, polyurethane resins, polyamide resins, epoxy resins, rosin, modified rosins, terpene resins, phenolic resins, hydrogenated petroleum resins, ionomer resins, silicone resins, ketone resins, and xylene resins. These resins can be used alone or in combination. Among these resins, polyester resins are preferably used.

The toner for use in the present invention preferably include awax as the release agent. The releasability of a toner largely depends on the state of the wax in toner particles, and it is preferable that the wax is finely dispersed in toner particles while the wax is mainly present in a surface portion of the toner particles to impart good releasability to the toner. The wax dispersed in the toner particles preferably has a major axis particle diameter not greater than 1 μm. By including a wax in the toner, the amount of the toner transferred to the fixing roller can be decreased.

Known waxes can be used for the toner for use in the present invention. Specific examples of the waxes include polyolefin waxes such as polyethylene waxes and polypropylene waxes; hydrocarbons having a long chain such as paraffin waxes and SASOL waxes; and waxes having a carbonyl group. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); anddialkyl ketones (e.g., distearyl ketone) Among these waxes having a carbonyl group, polyalkananoic acid esters are preferably used.

The melting point of the waxes for use in the toner of the present invention is from 40 to 160° C., preferably from 50 to 120° C., more preferably from 60 to 90° C. When the melting point of the wax used is too low, the preservability of the resultant toner deteriorates. In contrast, when the melting point is too high, the resultant toner tends to cause a cold offset problem in that a toner image adheres to a fixing roller when the toner image is fixed at a relatively low fixing temperature.

The waxes preferably have a melt viscosity of from 5 to 1000 mPa.s (i.e., 5 to 1000 cps), and more preferably from 10 to 100 mPa.s, at a temperature 20° C. higher than the melting point thereof. Waxes having too high a melt viscosity hardly produce offset resistance improving effect and low temperature fixability improving effect.

The content of a wax in the toner of the present invention is generally from 0 to 40% by weight, and preferably from 3 to 30% by weight.

The toner for use in the present invention preferably includes a charge controlling agent. In particular, by fixing a charge controlling agent on the surface of the toner particles, the resultant toner can have a high charge quantity and an improved charge stability.

Specific examples of the charge controlling agent include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

The content of the charge controlling agent in the toner is changed depending on the variables such as choice of binder resin, presence of additive and dispersion method, and cannot be unambiguously determined. However, the content is typically from 0.1 to 10 parts by weight, and preferably from 0.2 to 5 parts by weight, per 100 parts by weight of the binder resin included in the toner. When the content is too high, the resultant toner has too large a charging quantity. Therefore, the toner is strongly attracted by the developing roller used, resulting in deterioration of the fluidity of the toner and decrease of image density of the resultant images.

The release agent and the charge controlling agent can be kneaded together with the other toner constituents such as the binder resin and colorant (or colorant masterbatch) when the toner is prepared by a pulverization method. In the case of a polymerization toner, the charge controlling agent can be dissolved or dispersed in an organic solvent together with other toner constituents such as binder resin and colorant.

In the toner for use in the present invention, the tetrahydrofuran(THF)-soluble components of the toner preferably have an acid value parameter (i.e., the ratio of the acid value of the components to the molecular weight thereof) of from $0.3\times10^{-3}$ to $5.0\times10^{-3}$ mgKOH/g/Mw. Binder resins having a relatively low molecular weight typically have a relatively low melting point, a low storage modulus temperature TG' (which is mentioned below) at low temperature, and a low viscosity temperature Tη (which is also mentioned below) compared to binder resins having a relatively high molecular weight. Therefore, when such binder resins having low molecular weight are included in the toner, the toner has a low fixable temperature. However, such binder resins have a drawback in that the resultant toner tends to cause the offset problem at a relatively low fixing temperature, and the binder resins in the toner collected by the cleaning roller tends to be re-transferred to the pressing roller, resulting in occurrence of fouling on the backside of copy sheets.

In the present invention, the metal compound (i.e., the reactive agent, or the viscoelasticity increasing material) present on the cleaning roller efficiently reacts with such low molecular weight binder resins in the toner if the THF-soluble components in the binder resins have such an acid value parameter as mentioned above. The acid value parameter means the ratio of the acid value of the components to the molecular weight thereof and the higher acid value parameter a resin has, the more acid groups the resin has in a unit weight average molecular weight. Namely, when the acid value parameter of the THF-soluble components in the binder resin of the toner is in the range mentioned above, the weight average molecular weight (Mw), the storage modulus temperature (TG') and the viscosity temperature (Tη) of the components can be increased because the binder resin is reacted with the metal compound present on the surface of the cleaning roller. Therefore, occurrence of the toner re-transferring problem can be prevented.

When the acid value parameter is too high, the weight average molecular weight of the THF-soluble components cannot be increased to the extent such that the resultant toner does not cause the re-transferring problem. In contrast, when the acid value parameter is too low, the reaction of the metal compound on the cleaning roller with the binder resin cannot be performed at a high speed, and thereby the molecular weight of the binder resin can be hardly increased. Therefore, the toner re-transferring problem tends to occur.

It is preferable for the toner for use in the present invention that the THF-soluble components included in the toner have an average molecular weight Mw of from 5,000 to 30,000. In order to impart a good combination of low temperature fixability, hot offset resistance and high temperature preservability to the toner, it is important to control the weight average molecular weight of the binder resin in the toner such that the THF-soluble components included therein is in the above-mentioned range. When the weight average molecular weight Mw is too low, the high temperature preservability of the toner deteriorates. In contrast, when the weight average molecular weight Mw is too high, the low temperature fixability of the toner deteriorates.

The molecular weight of a resin is determined by a GPC (Gel Permeation Chromatography) method using tetrahydrofuran (THF) as a solvent. The measuring method is as follows.

At first, the column is stabilized in a heat chamber at 40° C. The solvent (i.e., THF) is flown through the column at a speed of 1 ml/minute. On the other hand, a resin to be measured is dissolved in THF to prepare a THF solution of the resin having a resin content of from 0.05 to 0.6% by weight. Then 50 to 200 μl of the THF solution of the resin is injected to the column to obtain a GPC spectrum.

The molecular weight of the resin is determined while comparing the molecular distribution curve thereof with the working curve which is previously prepared using several polystyrene standard samples each having a single molecular weight peak. Specific examples of the polystyrene standard samples include standard polystyrenes which are manufactured by Pressure Chemical Co. or Tosoh Corporation and each of which has a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

It is preferable to prepare a working curve using at least ten standard polystyrenes. A refractive index (RI) detector is used as the detector.

The THF-soluble components (typically, the binder resin) of the toner for use in the present invention preferably have an acid value of from 2.0 to 50.0 mgKOH/g to impart a good combination of low temperature fixability, hot offset resistance, high temperature preservability and charge stability to the toner. As mentioned below, a prepolymer capable of reacting with a compound having an active hydrogen is used for the binder resin. The prepolymer is reacted with a compound having an active hydrogen in the toner manufacturing process, and an extended and/or crosslinked polymer is prepared. This extended and/or crosslinked polymer is used as a binder resin, and thereby the above-mentioned properties can be imparted to the resultant toner. When the acid value is too high, the extension and/or crosslinking reaction cannot be well performed, and thereby the hot offset resistance of the toner deteriorates. In contrast, when the acid value is too low, the extension and/or crosslinking reaction excessively proceed, and thereby a desired toner cannot be stably produced.

The acid value is determined by a method defined in JIS K0070. In this case, the toner sample is not dissolved in a solvent, it is preferable to use dioxane or tetrahydrofuran as the solvent.

The toner of the present invention preferably has an average circularity not less than 0.94 such that the resultant toner has good transferability and can produce high quality images with good dot reproducibility.

When the average circularity of the toner is too small, the toner has poor transferability and thereby high quality images with high sharpness (i.e., without toner scattering) cannot be produced.

The average circularity of the toner can be determined by a flow-type particle image analyzer, FPIA-1000 manufactured by Sysmex Corp.

Specifically, the method is as follows:

(1) 0.1 g to 9.5 g of a sample to be measured is mixed with 100 to 150 ml of water from which solid impurities have been removed and which includes 0.1 ml to 0.5ml of a dispersant (i.e., a surfactant) such as an alkylbenzene sulfonic acid salt;

(2) the mixture is dispersed using an ultrasonic dispersing machine for about 1 to 3 minutes to prepare a suspension including particles of 3,000 to 10,000 per 1 micro-liter of the suspension; and (3) the average circularity and circularity distribution of the sample in the suspension are determined by the measuring instrument mentioned above.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The toner for use in the present invention preferably has a volume average particle diameter (Dv) of from 3.0 to 8.0 μm, and a ratio (Dv/Dn) (i.e. , a ratio of the volume average particle diameter (Dv) to the number average particle diameter (Dn)) of from 1.10 to 1.40.

When the toner has such a particle diameter (Dv) and a ratio (Dv/Dn) as mentioned above, the toner has a good combination of high temperature preservability, low temperature fixability and hot offset resistance.

In general, the smaller the particle diameter of a toner, the better the resolution of the toner images, but the worse the transferability and cleanability of the toner. When the toner for use in the present invention has too small volume average particle diameter, the transferability and the cleaning property of the toner deteriorate. When such a toner is used for a two component developer, the toner tends to cause a problem in that the developer is adhered and fixed to the carrier used, resulting in deterioration of the charging ability of the carrier. When the toner is used as a one component developer, the toner tends to form a film on developing members such as a developing roller and a developer layer forming blade.

In contrast, when the volume average particle diameter of the toner is too large, high resolution images cannot be produced and in addition a problem in that the particle diameter distribution of the toner largely changes when the toner is used while replenishing a fresh toner occurs.

When the ratio (Dv/Dn) is too large, the toner has a broad charge quantity distribution and the resultant images have poor resolution.

The volume average particle diameter (Dv), number average particle diameter (Dn) and particle diameter distribution of a toner can be measured using an instrument COULTER COUNTER TAII or MULTISIZER II from Coulter Electronics Inc., an interface by which particle diameter distributions on number basis and volume basis can be output and which is manufactured by Nikkaki Bios Co., Ltd., and a personal computer PC9801 manufactured by NEC Corp. In addition, the ratio Dv/Dn was determined on calculation.

The toner for use in the present invention preferably has a shape factor SF-1 of from 100 to 180 and another shape factor SF-2 of from 100 to 180.

Figure 7A:
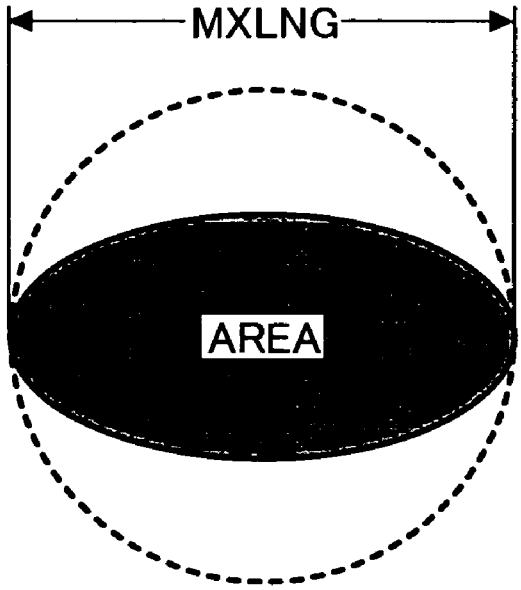
FIGS. 7A and 7B are schematic views for explaining how to determine the shape factors SF-1 and SF-2.
Figure 7B:
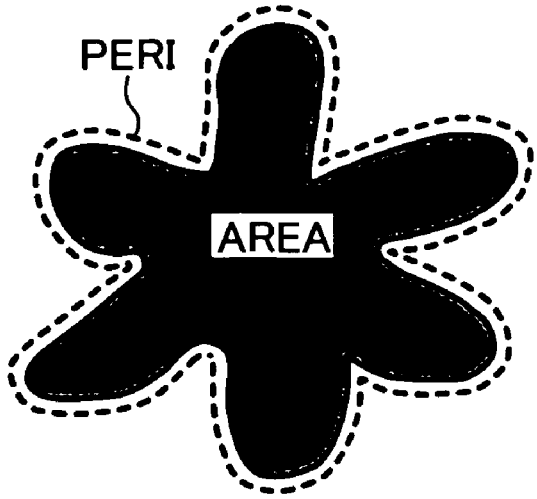
Figure 8A:
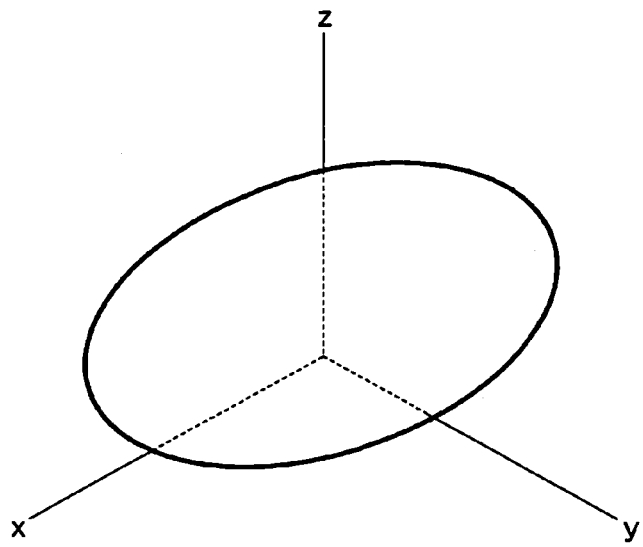
FIGS. 8A-8C are schematic views illustrating a typical particle of the toner of the present invention.
Figure 8B:
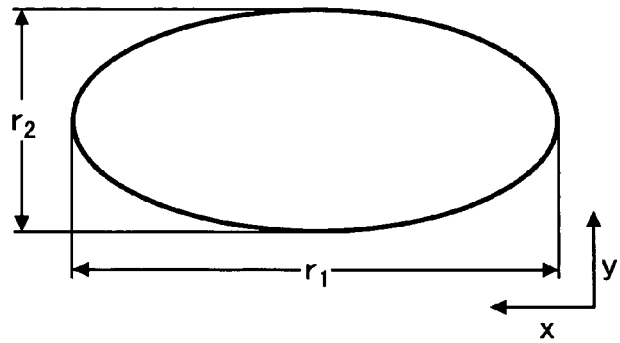
Figure 8C:
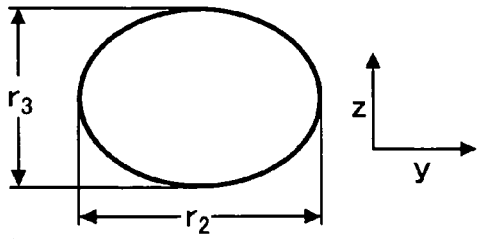

FIGS. 7A and 7B are schematic views for explaining the shape factors SF-1 and SF-2, respectively.

As illustrated in FIG. 7A, the shape factor SF-1 represents the degree of the roundness of a toner and is defined by the following equation (1):

$$SF\text{-}1=\{(MXLNG)^2/(\text{AREA})\}\times(100\,\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. In this case, the toner particles contact the other toner particles and the photoreceptor serving as an image bearing member at one point. Therefore, the adhesion of the toner particles to the other toner particles and the photoreceptor decreases, resulting in increase of the fluidity of the toner particles and the transferability of the toner. When the SF-1 is too large, the toner particles have irregular forms and thereby the toner has poor developability and poor transferability.

As illustrated in FIG. 7B, the shape factor SF-2 represents the degree of the concavity and convexity of a toner particle, and is defined by the following equation (2):

$$SF\text{-}2=\{(PERI)^2/(\text{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity) . It is preferable for a toner to have a slightly roughened surface because the toner has good cleanability. However, when the SF-2 is too large (i.e., the toner particles are seriously roughened), a toner scattering problem in that toner particles are scattered around a toner image is caused, resulting in deterioration of the toner image qualities.

The shape factors SF-1 and SF-2 are determined by the following method:

(1) particles of a toner are photographed using a scanning electron microscope (S-800, manufactured by Hitachi Ltd.); and (2) photograph images of 100 toner particles are analyzed using an image analyzer (LUZEX 3 manufactured by Nireco Corp.) to determine the SF-1 and SF-2.

The toner for use in the present invention preferably has a form similar to the spherical form, and preferably satisfies the following relationship:

$$0.5\leqq(r2/r1)\leqq1.0 \text{ and } 0.7\leqq(r3/r2)\leqq1.0,$$

wherein r1, r2 and r3 represent the average major axis particle diameter, the average minor axis particle diameter and the average thickness of particles of the toner, wherein $r3 \leqq r2 < r1$.

When the ratio (r2/r1) is too small, the toner has a form far away from the spherical form, and therefore the toner has good cleanability, but the dot reproducibility and transfer efficiency deteriorate, resulting in deterioration of image qualities. In contrast, when the ratio (r2/r1) is too large, the toner has a form near the spherical form and therefore the cleaning problem tends to occur, particularly, under low temperature and low humidity conditions.

When the ratio (r3/r2) is too small, the toner has a flat form and therefore the toner does not cause the toner scattering problem because of being similar to a toner having an irregular form. However, such a toner is inferior to a spherical toner in transferability. In particular, when the ratio (r3/r2) is 1.0, the toner easily rotates on its major axis, resulting in improvement of the fluidity of the toner. Therefore the toner has good transferability and can produce high quality images. In addition, the toner can be well mixed with a, carrier, and thereby the resultant two component developer has a narrow charge quantity distribution, thereby forming high definition images.

The above-mentioned size factors (i.e., r1, r2 and r3) of toner particles can be determined by observing the toner particles with a scanning electron microscope while the viewing angle is changed.

The toner for use in the image forming apparatus of the present invention can be prepared by a method such as pulverization methods and polymerization methods, but is preferably prepared by a polymerization method.

The toner is typically prepared by the following method, but is not limited thereto.

(1) a toner constituent mixture including at least a polymer capable of reacting with a compound having an active hydrogen atom, a polyester resin and a colorant is dissolved or dispersed in an organic solvent to prepare a toner constituent mixture liquid; and (2) the toner constituent mixture liquid is dispersed in an aqueous medium while the polymer is reacted with a compound having an active hydrogen so as to be crosslinked and/or extended, resulting in preparation of an emulsion including mother toner particles.

Then the toner constituents for use in the toner prepared by a polymerization method will be explained in detail.

Modified Polyester Resin

A modified polyester resin can be preferably used as a binder resin of the toner. The modified polyester resin is defined as polyester resins which include a bonding group other than the ester bond and functional groups of monomer units such as alcohols and acids, and resins in which a resin unit other than polyester resin units is bonded with polyester units through a covalent bond and an ionic bond. For example, polyester resins which are prepared by the following method can be preferably used as the modified polyester:

(1) a functional group such as isocyanate groups which can react with an acid group and a hydroxyl group is incorporated in an end portion of a polyester resin; and (2) the polyester resin is further reacted with a compound having an active hydrogen so that the end portion thereof is modified or extended.

In addition, polyester resins (such as urea-modified polyester resins and urethane-modified polyester resins) which are prepared by reacting end portions of polyester resins with a compound having a plurality of active hydrogen atoms can be used as the modified polyester resin.

Further, polyester resins (such as styrene-modified polyester resins and acrylic-modified polyester resins) which are prepared by incorporating a reactive group (such as double bond) in the main chain of a polyester resin and then inducing a radical polymerization using the reactive group to incorporate a graft component having a C-C bond or crosslinking the resin using the reactive group can also be used as the modified polyester resin.

Furthermore, polyester resins in which a resin unit is incorporated in the main chain thereof by copolymerization or a resin component is reacted with a functional group of a polyester resin such as carboxyl groups and hydroxyl groups can also be used as the modified polyester resin. Specific examples thereof include silicone-modified polyester resins in which a polyester resin is copolymerized with a silicone resin whose end portion is modified with a group such as carboxyl, hydroxyl, epoxy and mercapto groups.

Synthesis Example of Modified Polyester Resin

The modified polyester resin for use in the toner is prepared by, for example, the following method.

The following components are contained in a reaction container having a condenser, a stirrer and a nitrogen introducing tube and the mixture is reacted for 8 hours at 230° C. under normal pressure.

| | |
|---|---|
| Adduct of bisphenol A with 2 mole of ethylene oxide | 724 parts |
| Isophthalic acid | 200 parts |
| Fumaric acid | 70 parts |
| Dibutyl tin oxide | 2 parts |

Then the reaction is further continued for 5 hours under a reduced pressure of from 10 to 15 mmHg, followed by cooling to 160° C. Further, 32 parts of phthalic anhydride are added thereto to perform a reaction for 2 hours at 160° C.

After cooled to 80° C., the reaction product is reacted with 200 parts of styrene in ethyl acetate for 2 hours in the presence of 1 part of benzoyl peroxide and 0.5 parts of dimethylaniline, and ethyl acetate therein is removed by distillation. Thus, a styrene-modified polyester resin (1) in which a polyester resin is grafted with a polystyrene and which has a weight average molecular weight of 92,000 is prepared.

The toner for use in the image forming apparatus of the present invention preferably includes a urea-modified polyester (i), which is typically prepared by reacting a polyester prepolymer (A) having an isocyanate group with an amine (B), as the binder resin.

The prepolymers (A) are typically prepared by reacting a polycondensation product of a polyol (1) with a polycarboxylic acid (2), which has an active hydrogen, with a polyisocyanate (3). Specific examples of the groups having an active hydrogen include hydroxyl groups (such as alcoholic hydroxyl groups and phenolic hydroxyl groups), amino groups, carboxyl groups, mercapto groups, etc. Among these groups, alcoholic hydroxyl groups are preferable.

Suitable polyols (1) include diols (1-1) and polyols (1-2) having three or more hydroxyl groups. Preferably diols (1-1) or mixtures of a diol (1-1) with a small amount of a polyol (1-2) are used.

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferably used. More preferably, alkylene oxide adducts of bisphenols, or mixtures of an alkylene oxide adduct of bisphenols and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids include dicarboxylic acids (2-1) and polycarboxylic acids (2-2) having three or more carboxyl groups. Preferably, dicarboxylic acids (2-1) or mixtures in which a small amount of a polycarboxylic acid (2-2) is added to a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more carboxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (3) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the unit obtained from a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3 and more preferably from 1.8 to 2.5. When the number of the isocyanate group is too small, the molecular weight of the resultant urea-modified polyester decreases and thereby hot offset resistance deteriorate.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures of a diamine with a small amount of a polyamine (B2) are preferable.

The molecular weight of the urea-modified polyesters can be controlled using an elongation inhibitor, if desired. Specific examples of the elongation inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include a urethane bond as well as a urea bond. The molar ratio (urea/urethane) of the urea bond to the urethane bond-is from 100/0 to 10/90, preferably from 80/20 to 20/80 and more preferably from 60/40 to 30/70. When the content of the urea bond is too low, the hot offset resistance of the resultant toner deteriorates.

The main peak molecular weight of the modified polyesters is preferably from 1,000 to 10,000, and more preferably from 2,000 to 8,000. When the amount of resin components having a molecular weight less than 1,000 increases, the high temperature preservability of the resultant toner deteriorates. In contrast, when the amount of resin components having a molecular weight greater than 10,000 increases, the low temperature fixability of the toner deteriorates.

The content of resin components having a high molecular weight not less than 30,000 is preferably from 1 to 10% by weight, and more preferably from 3 to 6% by weight based on total weight of the modified polyester resin. When the content of such a high molecular weight resin components is too low, good hot offset resistance can not be imparted to the toner. In contrast, when the content is too high, the glossiness and transparency of the toner tend to deteriorate.

The polyester resin preferably includes tetrahydrofuran (THF)-insoluble components in an amount of from 1 to 25% by weight. In this case, the hot offset resistance of the toner can be improved. In addition, such toner hardly causes a problem in that the resultant toner is further pulverized by stresses generated when the toner is agitated in a developing device, and the toner contacts a developing roller, a toner supplying roller, a toner layer forming blade and a frictional charge generating blade, which results in generation of fine toner particles and/or embedding of the fluidizer present on toner particles into the toner particles, thereby deteriorating image qualities. When such a toner is used as a color toner, the glossiness and transparency of the resultant color toner images deteriorate although the hot offset resistance of the toner can be improved. From this point of view and to impart good releasability to the toner, the content of THF-insoluble components is preferably from 1 to 10% by weight.

Unmodified Polyester Resin

It is preferable to use a combination of a urea-modified polyester resin with an unmodified polyester resin as the binder resin. By using a combination of a urea-modified polyester resin with an unmodified polyester resin, the low temperature fixability of the toner can be improved and in addition the toner can produce color images having a high glossiness.

Suitable unmodified polyester resins include polycondensation products of a polyol (1) with a polycarboxylic acid (2). Specific examples of the polyol (1) and polycarboxylic acid (2) are mentioned above for use in the modified polyester resins (i). In addition, specific examples of the suitable polyol and polycarboxylic acid are also mentioned above.

In addition, as the unmodified polyester resins, polyester resins modified by a bond (such as urethane bond) other than a urea bond, can also be used as well as the unmodified polyester resins mentioned above.

When a combination of a modified polyester resin (i) with an unmodified polyester resin (ii) is used as the binder resin, it is preferable that the modified polyester resin at least partially mixes with the unmodified polyester resin to improve the low temperature fixability and hot offset resistance of the toner. Namely, it is preferable that the modified polyester resin has a molecular structure similar to that of the unmodified polyester resin. The mixing ratio (i/ii) of a modified polyester resin (i) to an unmodified polyester resin (ii) is from 5/95 to 60/40, preferably from 5/95 to 30/70, more preferably from 5/95 to 25/75, and even more preferably from 7/93 to 20/80. When the addition amount of the modified polyester resin is too small, the hot offset resistance of the toner deteriorates and in addition, it is impossible for the toner to achieve a good combination of high-temperature preservability and low temperature fixability.

The peak molecular weight of the unmodified polyester resins (ii) is from 1,000 to 20,000, preferably from 1,500 to 10,000 and more preferably from 2,000 to 8,000. When the peak molecular weight of the unmodified polyester resin is too low, the high-temperature preservability deteriorates. When the peak molecular weight thereof is too high, the low temperature fixability deteriorates.

The unmodified polyester resin (ii) preferably has a hydroxyl value not less than 5 mgKOH/g, and more preferably from 10 to 120 mgKOH/g, and even more preferably from 20 to 80 mgKOH/g. When the hydroxyl value is too low, the resultant toner has poor preservability and poor low temperature fixability.

The unmodified polyester resin (ii) preferably has an acid value of from 10 to 30 mgKOH/g. When an unmodified polyester resin (ii) having an acid value in this range is used, the resultant toner has good negative chargeability and good fixability. When the acid value is too high, the resultant toner has low charge quantity particularly under high humidity conditions, thereby causing the background fouling problem in that the resultant images have background fouling.

The unmodified polyester resin (ii) to be included in the toner for use in the image forming apparatus of the present invention preferably has a glass transition temperature (Tg) of from 35 to 55° C. and more preferably from 40 to 55° C. When the glass transition temperature is too low, the preservability of the toner deteriorates. In contrast, when the glass transition temperature is too high, the low temperature fixability deteriorates. When the toner includes a combination of a urea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners.

With respect to the storage modulus of the toner binder for use in the toner of the present invention, the temperature (TG') at which the toner has a storage modulus of 10,000 dyne/cm$^2$ at a frequency of 20 Hz is not lower than 100° C., and preferably from 110 to 200° C.

With respect to the viscosity of the binder resin, the temperature (Tη) at which the toner has a viscosity of 1,000 dyne/cm$^2$ at a frequency of 20 Hz is not higher than 180° C., and preferably from 90 to 160° C. When the temperature (Tη) is too high, the low temperature fixability of the toner deteriorates. In order to achieve a good combination of low temperature fixability and hot offset resistance, it is preferable that the TG' is higher than the Tη. Specifically, the difference (TG'−Tη) is preferably not less than 0° C., more preferably not less than 10° C. and even more preferably not less than 20° C. The difference particularly has an upper limit. In order to impart a good combination of high temperature preservability and low temperature fixability to the toner, the difference (TG'−Tη) is preferably from 0 to 100° C., more preferably from 10 to 90° C. and even more preferably from 20 to 80° C.

Release Agent and Charge Controlling Agent

The toner for use in the present invention preferably includes a release agent and a charge controlling agent. Specific examples thereof are mentioned above.

Colorant

The toner for use in the present invention includes a colorant. Suitable materials for use as the colorant include known dyes and pigments.

Specific examples of the dyes and pigments include carbon black, Nigrosine dyes, black iron oxide, Naphthol Yellow S (C.I. 10316), Hansa Yellow 10G (C.I. 11710), Hansa Yellow 5G (C.I. 11660), Hansa Yellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I.

12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R (C.I. 12310), Permanent Red F4R (C.I. 12335), Permanent Red FRL (C.I. 12440), PermanentRedFRLL (C.I. 12460), Permanent Red F4RH (C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl a-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

External Additive

Toner particles are preferably mixed with an external additive to improve the fluidity and other properties of the toner.

Inorganic fine particles are typically used as the external additive (i.e., fluidity improving agent). Inorganic particulate materials having a primary particle diameter of from 5 nm to 2 μm, and preferably from 5 nm to 500 nm, are preferably used. The surface area of the inorganic particulate materials is preferably from 20 to 500 $m^2/g$ when measured by a BET method.

The content of the inorganic particulate material is preferably from 0.01% to 5.0% by weight, and more preferably from 0.01% to 2.0% by weight, based on the total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatomearth, chromiumoxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by. a polymerization method such as polycondensation methods; and particles of a thermosetting resin can also be used as the external additive of the toner of the present invention.

The external additive used for the toner of the present invention is preferably subjected to a hydrophobizing treatment to prevent deterioration of the fluidity and charge properties of the resultant toner particularly under high humidity conditions. Suitable hydrophobizing agents for use in the hydrophobizing treatment include silicone oils, silane coupling agents, silylation agents, silane coupling agents having a fluorinated alkyl group, organic titanate coupling agents, aluminum coupling agents, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods.

Particulate resins having a relatively narrow particle diameter distribution and a volume average particle diameter of from 0.01 μm to 1 μm are preferably used as the cleanability improving agent.

Then the method for manufacturing the toner for use in the present invention will be explained.

The toner is typically prepared by the following method, but is not limited thereto.

Polymer Suspension Methods

At first, a resin, a prepolymer, a colorant (such as pigments), and other additives such as release agents, charge controlling agents and the like are dissolved or dispersed in a volatile organic solvent to prepare a toner constituent mixture liquid (i.e., an oil phase liquid). In order to decrease the viscosity of the oil phase liquid, i.e., in order to easily perform emulsification, volatile solvents which can dissolve the resin and prepolymer used are preferably used. The volatile solvents preferably have a boiling point lower than 100° C. so as to be easily removed after the granulating process.

Specific examples of the volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The added amount of the organic solvent is generally from 0 to 300 parts, preferably from 0 to 100 parts andmore preferably from 25 to 70 parts by weight, per 100 parts by weight of the prepolymer (A). When a solvent is used, the solvent is removed after the extension and/or crosslinking reaction of the prepolymer under normal pressure or a reduced pressure.

The thus prepared oil phase liquid is dispersed in an aqueous medium using the below-mentioned dispersing method.

Suitable aqueous media include water. In addition, other solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

In order to prepare a stable dispersant in which the oil phase liquid including the prepolymer and other toner constituents in an aqueous medium, it is preferable to mix the oil phase liquid and the aqueous phase while applying a shearing force. The toner constituents such as prepolymers and other constituents can be directly added into an aqueous medium, but it is preferable that the toner constituents are previously dissolved or dispersed in an organic solvent and then the solution or dispersion is mixed with an aqueous medium while applying a shearing force to prepare an emulsion. Further, materials such as colorants, release agents and charge controlling agents can be added to the emulsion or dispersion after the particles are formed. Specifically, colorless particles prepared by the above-mentioned methods can be colored by a known dyeing method.

As the dispersing machine, known mixers and dispersing machines such as low shearing force type dispersing machines, high shearing force type dispersing machines, friction type dispersing machines, high pressure jet type dispersing machines and ultrasonic dispersing machine can be used. In order to prepare a dispersion including particles having an average particle diameter of from 2 to 20 μm, high shearing force type dispersing machines are preferably used.

When high shearing force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes for batch dispersing machines. The temperature in the dispersing process is generally 0 to 150° C. (under pressure), and preferably from 40 to 98° C. The processing temperature is preferably as high as possible because the viscosity of the dispersion including a modified polyester resin (i) and a prepolymer (A) decreases and thereby the dispersing operation can be easily performed.

In the dispersing process, the weight ratio of the toner constituent mixture liquid (i.e., the oil phase liquid) including a prepolymer and other toner constituents to the aqueous medium is generally from 100/50 to 100/2000, and preferably from 100/100 to 100/1000. When the amount of the aqueous medium is too small, the particulate organic material tends not to be well dispersed, and thereby a toner having a desired particle diameter cannot be prepared. In contrast, to use a large amount of aqueous medium is not economical.

The aqueous medium optionally includes a dispersant as well as a particulate resin. When a dispersant is used, the resultant particles have a sharp particle diameter distribution and good dispersion stability.

When the urea-modified polyester resin is prepared in an aqueous medium using a prepolymer (A) andanamine (B), the amine can be added in the aqueous medium before the toner constituent mixture liquid is added to the aqueous medium. Alternatively, the amine (B) can be added to a mixture of the toner constituent mixture liquid and the aqueous medium. In this case, a reaction starts from the interfaces between the oil phase and the aqueous phase. Therefore, the resultant toner particles have a gradient-like concentration of the urea-modified polyester resin with a highest concentration at a surface side of the particles and a lowest concentration at the center thereof.

When the toner constituent mixture (i.e., the oil phase liquid) is dispersed (emulsified) in an aqueous medium (i.e., the aqueous phase liquid), a surfactant can be preferably used.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good charging properties and good charge rising property can be imparted to the resultant toner.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4)sulfonate, sodium 3-{omega-fluoroalkanoyl(C6-C8)-N-ethylamino}-1-propanesulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples ofthe marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In addition, inorganic dispersants which are hardly soluble in water, such as tircalcium phosphate, calcium carbonate, titanium oxide, colloidal silica, and hydroxyapatite can also be used.

Further, it is possible to stably disperse the toner constituent mixture liquid in an aqueous liquid using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When the dispersing operation is performed while using a dispersant, it is possible not to remove the dispersant from the resultant toner particles. However, it is preferable to remove the dispersant remaining on the surface of the resultant particulate organic material after the elongation and/or crosslinking reaction of the prepolymer. For example, when a dispersant such as calcium phosphate which can be dissolved in an acid or an alkali is used, the particles are preferably washed after the extension and/or crosslinking reactions by a method in which the particles are washed with an acid such as hydrochloric acid to dissolve the dispersant, and then washed with water. In addition, such dispersants can also be removed from the resultant particles by a method using an enzyme.

The elongation time and/or crosslinking time of the particles are determined depending on the reactivity of the isocyanate of the prepolymer (A) used with the amine used. However, the elongation time and/or crosslinking time are typically from 10 minutes to 40 hours, and preferably from 2 to 20 hours. The reaction temperature is typically from 0 to 150° C. and preferably from 40° C. to 98° C. In addition, known catalysts such as dibutyl tin laurate and dioctyl tin laurate can be added, if desired, when the reaction is performed.

In order to remove the organic solvent from the thus prepared emulsion, a method in which the emulsion is gradually heated to perfectly evaporate the organic solvent in the drops of the oil phase can be used. Alternatively, a method in which the emulsion is sprayed in a dry environment to dry the organic solvent in the drops of the oil phase and water in the dispersion, resulting in formation of toner particles, can also be used. Specific examples of the dry environment include gases of air, nitrogen, carbon dioxide, combustion gas, etc., which are preferably heated to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to perform the classification operation in the liquid having the particles in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared toner particles are then mixed with one or more other particulate materials such as release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 μm. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins-such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer.

The thus prepared mother toner particles are mixed with an external additive (e.g., hydrophobized silica and titanium oxide) using a mixer to improve fluidity, developing properties and transferring properties of the toner particles.

Suitable mixers for use in mixing the mother toner particles and an external additive include known mixers for mixing powders, which preferably have a jacket to control the inside temperature thereof.

By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed.

In addition, a mixing method in which at first a relatively high stress is applied and then a relatively low stress is applied to the external additive, or vice versa, can also be used.

Specific examples of the mixers include V-form mixers, locking mixers, Loedge Mixers, Nauter Mixers, Henschel Mixers and the like mixers.

The image forming apparatus of the present invention will be explained referring to FIG. 9.

Figure 9:
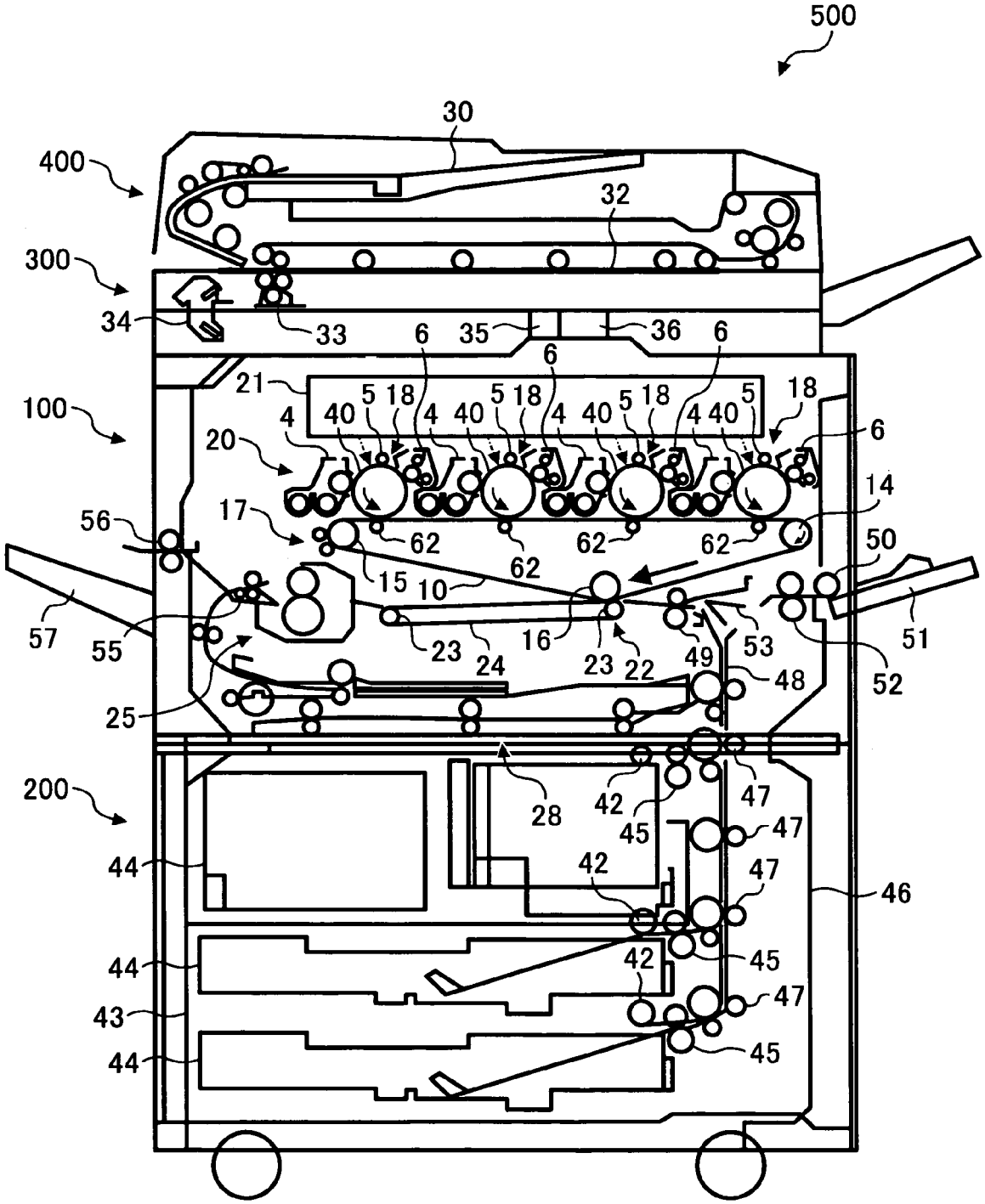
FIG. 9 is a schematic view illustrating an embodiment of the image forming apparatus of the present invention.

FIG. 9 is the overview of an embodiment of the image forming apparatus of the present invention, which is a tandem-type color image forming apparatus.

In FIG. 9, a tandem-type color image forming apparatus 500 includes an image forming section 100 (i.e., a main body of the image forming apparatus), a paper feeding section 200, a scanner 300 and an automatic document feeder 400.

The image forming section 100 includes an endless intermediate transfer medium 10 which is provided in the center of the image forming section 100. The intermediate transfer medium 10 is rotated in the clockwise direction by rollers 14, 15 and 16 while tightly stretched by the rollers. A cleaner 17 is provided near the roller 15 to remove toner particles remaining on the surface of the intermediate transfer medium.

Four image forming units 18 for forming yellow, magenta, cyan and black toner images are arranged side by side on the intermediate transfer medium 10. The image forming units 18 include respective photoreceptors 40. Numeral 20 denotes a tandem type developing device. The developing device 20 includes four developing devices arranged in the respective four image forming units 18. A light irradiator 21 which irradiate the image bearing member with imagewise light to form an electrostatic latent image on the image bearing member is arranged at a location over the image forming units 18.

A second transfer device 22 is provided below the intermediate transfer medium 10. The second transfer device 22 includes an endless belt 24 which is rotatably stretched around a pair of rollers 23. The endless belt 24 feeds a recording material so that the toner images on the intermediate transfer medium 10 are transferred to the recording material while sandwiched by the intermediate transfer medium 10 and the endless belt 24.

A fixing device 25 is arranged at a position near the second transfer device 22. As illustrated in FIG. 2, the fixing device 25 includes an endless fixing belt 264 and a pressing roller 262 which presses the fixing belt 264.

The second transfer device 22 also has a sheet feeding function of feeding recording paper sheets to the fixing device 25. It is also possible that the second transfer device 22 includes a transfer roller and a non-contact charger. In this case, the second transfer device cannot have a function of feeding recording paper sheets.

In addition, a sheet reversing device 28 configured to reverse the receiving material is provided at a position near the fixing device 25, to produce double-sided copies.

Each image forming device 18 includes a developing device 4 which contains the toner (developer) mentioned above. The developing device 4 includes a developer bearing member configured to bear and feed the toner to a position of the developer bearing member facing the photoreceptor 40. The developing device 4 develops an. electrostatic latent image on the photoreceptor 40 with the developer while applying an alternate voltage. By applying an alternate voltage to the developer, the developer is activated, and thereby the developer has a narrow charge quantity distribution, resulting in improvement of the developability of the developer.

A process cartridge including at least a photoreceptor and a developing device, which are integrated onto a unit and which can be detachably attached to the image forming apparatus, can also be used. The process cartridge can include other devices such as chargers and cleaners.

Then the full color image forming operation using the tandem-type color image forming apparatus 500 will be explained.

An original to be copied is set on an original table 30 of the automatic document feeder 400. Alternatively, the original is directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34 which move in the right direction. In the case where the original is set on the table 30 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black, yellow, magenta and cyan color image data) is provided.

The black, yellow, magenta and cyan color image data are sent to the respective black, yellow, magenta and cyan color image forming units 18, and black, yellow, magenta and cyan color toner images are formed on the respective photoreceptors 40. Each of the image forming units 18 includes a charger 5 configured to charge the image bearing member 40, the developing device 4, and an image bearing member cleaning device 6 configured to clean the surface of the image bearing member 40.

The thus prepared black, yellow, magenta and cyan color toner images are transferred one by one to the intermediate transfer medium 10 which is rotated by the rollers 14, 15 and 16, resulting in formation of a full color toner image on the intermediate transfer medium 10. Numeral 62 denotes a transfer charger.

On the other hand, one of paper feeding rollers 42 is selectively rotated to feed the top paper sheet of paper sheets stacked in a paper cassette 44 in a paper bank 43 while the paper sheet is separated one by one by a separation roller 45 when plural paper sheets are continuously fed. The paper sheet is fed to a passage 48 in the image forming section 100 through a passage 46 in the paper feeding section 200, and is stopped once by a pair of registration rollers 49. Numeral 47 denotes feed rollers. A paper sheet can also be fed from a manual paper tray 51 to a passage 53 by a feed roller 50 and a pair of separation rollers 52. The thus fed paper sheet is also stopped once by the registration roller pair 49. The registration rollers 49 are generally grounded, but a bias can be applied thereto to remove paper dust therefrom.

The thus prepared full color toner image on the intermediate transfer medium 10 is transferred to the paper sheet, which is timely fed by the registration roller pair 49, at the contact point of the second transfer device 22 and the intermediate transfer medium 10. Toner particles remaining on the surface of the intermediate transfer medium 10 even after the second image transfer operation are removed therefrom by the cleaner 17.

The paper sheet having the full color toner image thereon is then fedby the second transfer device 22 to the fixing device 25, and the toner image is fixed on the paper sheet upon application of heat and pressure. Then the paper sheet is discharged from the image forming section 100 by a pair of discharge rollers 56 while the path is properly selected by a paper path changing pick 55. Thus, a copy is stacked on a tray 57. When a double sided copy is produced, the paper sheet having a toner image on one side thereof is fed to the sheet reversing device 28 to be reversed. Then the paper sheet is fed to the second transfer device 24 so that an image is transferred to the other side of the paper sheet. The image is also fixed by the fixing device 25 and then the copy is discharged to the tray 57 by the discharge roller 56.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example 1

Synthesis of Modified Polyester Resin (A-1)

The following components were contained in a reaction vessel equipped with a condenser, a stirrer and a nitrogen introducing tube and reacted for 8 hours at 230° C. under normal pressure.

| | |
|---|---|
| Ethylene oxide adduct (2 mole) of bisphenol A | 358 parts |
| Propylene oxide adduct (2 mole) of bisphenol A | 381 parts |
| Isophthalic acid | 200 parts |
| Terephthalic acid | 127 parts |
| Dibutyl tin oxide | 2 parts |

The reaction was further continued for 5 hours under a reduced pressure of from 10 to 15 mmHg while removing water generated.

Thus, a polyester prepolymer having a hydroxyl value of 25 mgKOH/g and an acid value of 0.9 mgKOH/g was prepared.

After the reaction product including the polyester prepolymer was cooled to 80° C., 364 parts of ethyl acetate and 98 parts of isophoron diisocyanate were added thereto, and the mixture was reacted for 2 hours.

Thus, an ethyl acetate solution of a modified polyester resin (A-1) having a weight average molecular weight Mw of 12,000 and including an isocyanate group in an amount of 1.29% was prepared. The solution had a solid content of 75%.

Manufacturing Example 2

Preparation of Blocked Amine Compound (B)

In a reaction vessel equipped with a stirrer and a thermometer, 30 parts of isophorone diamine and 70 parts of methyl ethyl ketone were contained and reacted for 5 hours at 50° C. to prepare a blocked amine compound (B).

Manufacturing Example 3

Preparation of Unmodified Polyester Resin (1)

The following components were contained in a reaction vessel equipped with a condenser, a stirrer and a nitrogen introducing tube to perform a polycondensation reaction for 8 hours at 230° C. under normal pressure.

| | |
|---|---|
| Ethylene oxide adduct (2 mole) of bisphenol A | 229 parts |
| Propylene oxide adduct (3 mole) of bisphenol A | 529 parts |
| Terephthalic acid | 208 parts |
| Adipic acid | 46 parts |
| Dibutyl tin oxide | 2 parts |

The reaction was further continued for 5 hours under a reduced pressure of from 10 to 15 mmHg. Then 44 parts of trimellitic anhydride were added thereto and the mixture was reacted for 1.8 hours at 180° C. under normal pressure. Thus, an unmodified polyester resin (1) was prepared.

The unmodified polyester resin (1) had a number average molecular weight (Mn) of 2,500, a weight average molecular weight (Mw) of 6,700, a peak molecular weight of 5,000, a glass transition temperature of 43° C., and an acid value of 25 mgKOH/g.

Manufacturing Example 4

Preparation of Masterbatch (1)

The following components were mixed with a pressure kneader.

| | |
|---|---|
| Carbon black (PRINTEX 35 from Degussa AG, having a DBP oil absorption of 42 ml/100 mg and a pH of 9.5) | 540 parts |
| Polyester resin (1) | 1,200 parts |
| Water | 1,200 parts |

The mixture was kneaded with a two-roll mill for 30 minutes at 150° C., followed by roll cooling and pulverization with a pulverizer (manufactured by Hosokawa Micron Co., Ltd.). Thus, a masterbatch (1) was prepared.

Preparation of Mother Toner Particles

At fist, a mixture of a carnauba wax and ethyl acetate was subjected to a dispersion treatment using a bead mill so that the carnauba wax has an average particle diameter of 0.5 μm. Then 100 parts of the masterbatch prepared above, 50 parts of the carnauba wax dispersion having a solid content of 10% and 70 parts of ethyl acetate were mixed and agitated in a beaker to prepare a dispersion. Then 20 parts of the ethyl acetate solution of the modified polyester resin (A-1) and 1.2 parts of the blocked amine compound (B) were added to the dispersion to prepare a toner constituent mixture liquid having a solid content of 50%.

Then, 560 parts of water, 3.6 parts of an aqueous dispersion of a polymethyl methacrylate resin (PB-200H from Kao Corp.) and 3 parts of sodium dodecylnaphthalenesulfonate were added to the above-prepared toner constituent mixture liquid, and the mixture was agitated for 1 minute at 25° C. using a TK HOMOMIXER rotated at a revolution of 12,000 rpm. Thus, an emulsion (X) was prepared.

Then 100 parts of the emulsion (X) were contained in a stainless flask having a helical ribbon type triple agitator and was agitated for 6 hours at 25° C. under a reduced pressure of 10 kPa, to remove the solvent (i.e., ethyl acetate) to an extent such that the concentration of the solvent in the emulsion is 8%. In this case, the revolution of the agitator was 60 rpm. Thus, an emulsion (Y-1) was prepared.

Then 1.9 parts of a carboxymethyl cellulose (CELLOGEN HH from Dai-ichi Kogyo Seiyaku Co., Ltd.) were added to the emulsion (Y-1) to increase the viscosity of the emulsion. The viscosity of the emulsion was increased 10 hours after the addition. The emulsion was agitated with the agitator at a revolution of 300 rpm under a reduced pressure of 10 kPa until the concentration of ethyl acetate in the emulsion became 3%. Further, the emulsion was agitated at a revolution of 60 rpm until the concentration of ethyl acetate in the emulsion became 1%. In this case, the viscosity of the emulsion was 6,000 mPa.s.

Then 100 parts of the thus prepared emulsion were subjected to a centrifugal treatment. The resultant cake was mixed with 60 parts of water, and the mixture was subjected to a centrifugal treatment. This operation was repeated 5 times. Then the cake was dried for 48 hours at 35° C. Thus, a mother toner (1) was prepared.

One hundred (100) parts of the thus prepared mother toner particles and 0.25 parts of a charge controlling agent (BONTRON® X-11 from Orient Chemical Industries Ltd., which is a metal salt of a salicylic acid derivative) were mixed in a Q-form mixer manufactured by Mitsui Mining Co., Ltd., under the following conditions:

Peripheral speed of turbine blade: 50 m/sec; and

Mixing operation: a cycle in which the turbine blade is rotated for 2 minutes, followed by a pause for 1 minute was repeated 5 times.

Further, 0.5 parts of a hydrophobized silica (H2000 from Clariant Japan) were added to the toner particles, and the mixture was agitated by the Q-form mixer under a mixing condition such that a cycle in which turbine blade is rotated for 0.5 minutes, followed by a pause for 1 minute was repeated 5 times.

Thus, a black toner was prepared.

Manufacturing Example of Carrier

The following components were mixed using a HOMOMIXER to prepare a coating liquid.

| | |
|---|---|
| Silicone resin (straight silicone resin) | 100 parts |
| Toluene | 100 parts |
| γ-(2-aminoethyl)aminopropyltrimethoxysilane | 5 parts |
| Carbon black | 10 parts |

One thousand (1,000) parts of a spherical magnetite having a particle diameter of 50 μm were coated with the thus prepared coating liquid using a fluidized bed coating device. Thus, a magnetic carrier A was prepared.

Four (4) parts of the toner prepared above and 96 parts of the magnetic carrier A were mixed to prepare a two-component developer (1).

Example 1

The developer (1) was set in an image forming apparatus IMAGIO NEO 451 from Ricoh Co., Ltd., which includes a fixing device having a constitution similar to that of the fixing device illustrated in FIG. 1 except that the fixing roller 251 has two heaters therein; the pressure roller has no heater therein; and the cleaning roller 256 is not provided. Images were formed on a recording material, MY RECYCLE PAPER 100W from Ricoh Co., Ltd. The cleaning roller used for the fixing device of the image forming apparatus is made of aluminum and has a length and diameter of 300 mm and 10 mm, respectively. In addition, the surface of the cleaning roller has a ten point mean roughness Rz of 10 μm. Further, a layer including a reactive agent (i.e., a viscoelastisity increasing material) was formed on the surface of the cleaning roller by coating a coating liquid, which was prepared by dissolving BONTRON X-11 from Orient chemical Industries Co., Ltd. in toluene, using a brush, and then drying the coated liquid. The coating weight of the reactive agent was 0.07 g on a dry basis.

Evaluation Method

A running test in which double-sided copies of an A-4 size original chart having an image area proportion of 6% were continuously produced while checking whether the offset problem due to re-transferring of the toner collected by the cleaning roller occurs.

The evaluation was performed as follows:

○: The hot offset problem did not occur.

Δ: The hot offset was observed.

X: The recording paper was adhered to the roller, i.e., a paper jamming problem occurred.

Comparative Example 1

The procedure for-preparation and evaluation of the developer and the cleaning roller in Example 1 was repeated except that the reactive agent (BONTRON X-11) was not coated on the surface of the cleaning roller.

The results are shown in Table 1.

TABLE 1

| | Hot offset | |
|---|---|---|
| | after 40,000 copies | after 140,000 copies |
| Example 1 | ○ | Δ |
| Comparative Example 1 | Δ | X<br>A paper jamming problem occurred at 65,000 copies. |

This document claims priority and contains subject matter related to Japanese Patent Applications Nos. 2004-039107, 2004-218496 and 2004-222780, filed on Feb. 16, 2004, Jul.27, 2004 and Jul. 30, 2004, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by letters patent of the united states is:

1. A fixing device for fixing a toner image, comprising:

a fixing member configured to fix the toner image on a recording material upon application of heat and pressure thereto;

a coating roller configured to coat an oil on the fixing member;

a first cleaning member configured to clean a surface of the fixing member;

a pressing member configured to press the recording material toward the fixing member, the pressing member having a relatively lower temperature than the fixing member;

a second cleaning member configured to clean and collect toner from a surface of the pressing member while contacting the pressing member, wherein the second cleaning member has an outermost layer contacting the pressing member; and a supplying member configured to supply a viscoelasticity increasing material to a surface of the pressing member, wherein the viscoelasticity increasing material is transferred from the pressing member to an outermost layer of the second cleaning member so that the outermost layer of the second cleaning member including the viscoelasticity increasing material increases viscoelasticity of a binder resin included in the collected toner by reacting with the binder resin.

2. The fixing device according to claim 1, wherein the fixing member is either a fixing roller or a fixing belt supported by a plurality of rollers.

3. The fixing device according to claim 1, wherein the outermost layer of the second cleaning member further comprises a binder resin.

4. The fixing device according to claim 3, wherein the binder resin of the outermost layer has a material which is the same as a material included in the binder resin of the toner.

5. The fixing device according to claim 3, wherein the binder resin is included in the outermost layer in an amount of from 5 to 80% by weight based on total weight of the outermost layer.

6. The fixing device according to claim 1, wherein the outermost layer of the second cleaning member includes a metal compound.

7. The fixing device according to claim 1, wherein a surface of the second cleaning member has a ten point mean roughness Rz of from 3 to 50 μm.

8. The fixing device according to claim 1, further comprising:

an air blower configured to blow air on the second cleaning member to cool the second cleaning member.

9. The fixing device according to claim 1, wherein the toner further comprises at least one of a release agent and a charge controlling agent.

10. The fixing device according to claim 1, wherein the toner has an average circularity not less than 0.94.

11. The fixing device according to claim 1, wherein the toner is prepared by a method comprising:

dissolving or dispersing a toner constituent mixture including a polymer capable of reacting with an active hydrogen atom, a polyester resin, and the colorant in an organic solvent to prepare a toner constituent mixture liquid; and dispersing the toner constituent mixture liquid in an aqueous medium while subjecting the polymer to at least one of an extension reaction and a crosslinking reaction using a compound having an active hydrogen atom to prepare a dispersion including toner particles including the binder resin.

12. The fixing device according to claim 1, wherein the toner has a volume average particle diameter of from 3.0 to 8.0 μm, and a ratio (Dv/Dn) of the volume average particle diameter (Dv) to a number average particle diameter (Dn) of from 1.00 to 1.40.

13. The fixing device according to claim 1, wherein the toner has a first shape factor SF-1 of from 100 to 180 and a second shape factor SF-2 of from 100 to 180.

14. The fixing device according to claim 1, wherein the toner has substantially a spherical form satisfying the following relationships:

$$0.5 \leqq r2/r1 \leqq 1.0, \text{ and } 0.7 \leqq r3/r2 \leqq 1.0,$$

wherein r1 represents an average major axis particle diameter of the toner, r2 represents an average minor axis particle diameter of the toner, and r3 represent an average thickness of the toner, wherein r3≦r2≦r1.

15. The fixing device according to claim 1, wherein tetrahydrofuran-soluble components included in the toner have an acid value parameter of from $0.3\times10^{-3}$ to $5.0\times10^{-3}$ mgKOH/Mw.

16. The fixing device according to claim 1, wherein tetrahydrofuran-soluble components included in the toner have an average molecular weight of from 5,000 to 30,000.

17. The fixing device according to claim 1, wherein tetrahydrofuran-soluble components included in the toner have an acid value of from 2.0 to 50.0 mgKOH/g.

18. An image forming apparatus comprising:

an image bearing member configured to bear an electrostatic latent image on a surface thereof a charger configured to charge the image bearing member;

a light irradiator configured to irradiate the charge image bearing member with imagewise light to prepare the electrostatic latent image;

a developing device configured to develop the latent image with a developer comprising a toner comprising a binder resin and a colorant to form a toner image on the surface of the image bearing member;

a transfer device configured to transfer the toner image on a recording material;

an image bearing member's cleaner configured to clean the surface of the image bearing member; and the fixing device configured to fix the toner image on the recording material, wherein the fixing device comprises:

a fixing member configured to fix the toner image upon application of heat and pressure thereto;

a coating roller configured to coat an oil on the fixing member;

a first cleaning member configured to clean a surface of the fixing member;

a pressing member configured to press the recording material toward the fixing member, the pressing member having a relatively lower temperature than the fixing member;

a second cleaning member configured to clean and collect toner from a surface of the pressing member while contacting the surface of the pressing member, wherein the second cleaning member has an outermost layer contacting the surface of the pressing member; and a supplying member configured to supply a viscoelasticity increasing material to a surface of the pressing member, wherein the viscoelasticity increasing material is transferred from the pressing member to the outermost layer of the second cleaning member so that the outermost layer of the second cleaning member including the viscoelasticity increasing material increases viscoelasticity of the binder resin of the collected toner by reacting with the binder resin.

19. The image forming apparatus according to claim 18, wherein the fixing member is either a fixing roller or a fixing belt supported by a plurality of rollers.

20. The image forming apparatus according to claim 18, wherein the outermost layer further comprises a binder resin.

21. The image forming apparatus according to claim 20, wherein the binder resin of the outermost layer has a material which is the same as a material included in the binder resin of the toner.

22. The image forming apparatus according to claim 20, wherein the binder resin is included in the outermost layer in an amount of from 5 to 80% by weight based on total weight of the outermost layer.

23. The image forming apparatus according to claim 18, wherein the outermost layer of the second cleaning member includes a metal compound.

24. The image forming apparatus according to claim 18, wherein a surface of the second cleaning member has a ten point mean roughness Rz of from 3 to 50 μm.

25. The image forming apparatus according to claim 18, wherein the fixing device further comprises:

an air blower configured to blow air on the second cleaning member to cool the second cleaning member.

26. The image forming apparatus according to claim 18, wherein the toner further comprises at least one of a release agent and a charge controlling agent.

27. The image forming apparatus according to claim 18, wherein the toner has an average circularity not less than 0.94.

28. The image forming apparatus according to claim 18, wherein the toner is prepared by a method comprising:

dissolving or dispersing a toner constituent mixture including a polymer capable of reacting with an active hydrogen atom, a polyester resin, and the colorant in an organic solvent to prepare a toner constituent mixture liquid; and dispersing the toner constituent mixture liquid in an aqueous medium while subjecting the polymer to at least one of an extension reaction and a crosslinking reaction using a compound having an active hydrogen atom to prepare a dispersion including toner particles including the binder resin.

29. The image forming apparatus according to claim 18, wherein the toner has a volume average particle diameter of from 3.0 to 8.0 μm, and a ratio (Dv/Dn) of the volume average particle diameter (Dv) to a number average particle diameter (Dn) of from 1.00 to 1.40.

30. The image forming apparatus according to claim 18, wherein the toner has a first shape factor SF-1 of from 100 to 180 and a second shape factor SF-2 of from 100 to 180.

31. The image forming apparatus according to claim 18, wherein the toner has substantially a spherical form satisfying the following relationships:

$$0.5 \leqq r2/r1 \leqq 1.0, \text{ and } 0.7 \leqq r3/r2 \leqq 1.0,$$

wherein r1, represents an average major axis particle diameter of the toner, r2 represents an average minor axis particle diameter of the toner, and r3 represents an average thickness of the toner, wherein $r3 \leqq r2 \leqq r1$.

32. The image forming apparatus according to claim 18, wherein tetrahydrofuran-soluble components included in the toner have an acid value parameter of from $0.3\times10^{-3}$ to $5.0\times10^{-3}$ mgKOH/Mw.

33. The image forming apparatus according to claim 18, wherein tetrahydrofuran-soluble components included in the toner have an average molecular weight of from 5,000 to 30,000.

34. The image forming apparatus according to claim 18, wherein tetrahydrofuran-soluble components included in the toner have an acid value of from 2.0 to 50.0 mgKOH/g.

35. The image forming apparatus according to claim 18, further comprising a process cartridge which can be detachably set in the image forming apparatus, wherein the process cartridge comprises the image bearing member and at least one of the charger, developing device and the image bearing member's cleaner.

* * * * *